US007215912B2

(12) United States Patent
Yamaguchi et al.

(10) Patent No.: US 7,215,912 B2
(45) Date of Patent: May 8, 2007

(54) INTERMEDIATE TRANSFER MEDIUM AND IMAGE FORMING APPARATUS USING THE INTERMEDIATE TRANSFER MEDIUM

(75) Inventors: Takeo Yamaguchi, Yokohama (JP); Mitsuru Naruse, Tagata-gun (JP)

(73) Assignee: Ricoh Company Limited, Tokyo (JP)

( * ) Notice: Subject to any disclaimer, the term of this patent is extended or adjusted under 35 U.S.C. 154(b) by 200 days.

(21) Appl. No.: 11/079,119

(22) Filed: Mar. 15, 2005

(65) Prior Publication Data

US 2005/0207800 A1 Sep. 22, 2005

(30) Foreign Application Priority Data

Mar. 19, 2004 (JP) ..... 2004-081148
Sep. 14, 2004 (JP) ..... 2004-267615

(51) Int. Cl.
*G03G 15/01* (2006.01)

(52) U.S. Cl. ..... 399/302; 399/308

(58) Field of Classification Search ..... 399/66, 399/222, 252, 297, 302, 308, 312, 313
See application file for complete search history.

(56) References Cited

U.S. PATENT DOCUMENTS 5,243,392 A * 9/1993 Berkes et al. ..... 399/308
5,456,987 A * 10/1995 Badesha ..... 428/421
5,946,538 A * 8/1999 Takeuchi et al. ..... 399/302
5,978,638 A * 11/1999 Tanaka et al. ..... 399/302
5,999,780 A * 12/1999 Mort et al. ..... 399/266
6,042,917 A * 3/2000 Schlueter et al. ..... 428/60
6,284,424 B1 9/2001 Iimura et al.
6,311,036 B1 * 10/2001 Jia et al. ..... 399/302
6,611,672 B2 * 8/2003 Aoki et al. ..... 399/359
6,922,542 B2 * 7/2005 Mizuno et al. ..... 399/302
2006/0154168 A1 * 7/2006 Tomita et al. ..... 430/109.4

FOREIGN PATENT DOCUMENTS

JP 58-187968 11/1983
JP 63-34570 2/1988
JP 63-34571 2/1988
JP 1-282571 11/1989
JP 2-183276 7/1990
JP 2-198476 8/1990
JP 2-213881 8/1990
JP 3-242667 10/1991

(Continued)

*Primary Examiner*—Robert Beatty
(74) *Attorney, Agent, or Firm*—Oblon, Spivak, McClelland, Maier & Neustadt, P.C.

(57) ABSTRACT

An intermediate transfer medium on which a toner image is to be transferred, having a property such that a surface potential thereon decays with time t according to an equation $V=A\exp(-t/\tau)$ wherein V represents the surface potential of the intermediate transfer medium in absolute value; A is a constant; and $\tau$ is a dielectric relaxation time constant, wherein the dielectric relaxation time constant is less than 1.5 seconds. An image forming apparatus including an image bearing member configured to bear an electrostatic latent image thereon; a developing device configured to develop the latent image with a developer including a toner to form a toner image on the image bearing member; the intermediate transfer medium mentioned above configured to receive the toner image from the image bearing member; and a transfer device configured to transfer the toner image to a receiving material.

22 Claims, 4 Drawing Sheets

FOREIGN PATENT DOCUMENTS

| | | | | |
|---|---|---|---|---|
| JP | 4-147170 | | | 5/1992 |
| JP | 4-305666 | | | 10/1992 |
| JP | 5-40417 | | | 2/1993 |
| JP | 5-46035 | | | 2/1993 |
| JP | 5-307344 | | | 11/1993 |
| JP | 5-311016 | | | 11/1993 |
| JP | 5-313526 | | | 11/1993 |
| JP | 5-323802 | | | 12/1993 |
| JP | 6-93175 | | | 4/1994 |
| JP | 6-149081 | | | 5/1994 |
| JP | 6-149083 | | | 5/1994 |
| JP | 6-234903 | | | 8/1994 |
| JP | 7-24912 | | | 1/1995 |
| JP | 7-92825 | | | 4/1995 |
| JP | 7-156287 | | | 6/1995 |
| JP | 8-30117 | | | 2/1996 |
| JP | 8-176319 | | | 7/1996 |
| JP | 8-267605 | | | 10/1996 |
| JP | 9-269676 | | | 10/1997 |
| JP | 10-10880 | | | 1/1998 |
| JP | 10-20538 | | | 1/1998 |
| JP | 10-166508 | | | 6/1998 |
| JP | 10-319727 | | | 12/1998 |
| JP | 11-24427 | | | 1/1999 |
| JP | 11-30915 | | | 2/1999 |
| JP | 11-119560 | | | 4/1999 |
| JP | 11-156971 | | | 6/1999 |
| JP | 11-170389 | | | 6/1999 |
| JP | 11-231678 | | | 8/1999 |
| JP | 11272091 | A | * | 10/1999 |
| JP | 2000-172085 | | | 6/2000 |
| JP | 2001-13801 | | | 1/2001 |
| JP | 2001-18284 | | | 1/2001 |
| JP | 2001-31849 | | | 2/2001 |
| JP | 2002139960 | A | * | 5/2002 |
| JP | 2003-177610 | | | 6/2003 |

* cited by examiner

INTERMEDIATE TRANSFER MEDIUM AND IMAGE FORMING APPARATUS USING THE INTERMEDIATE TRANSFER MEDIUM

BACKGROUND OF THE INVENTION

1. Field of the Invention

The present invention relates to an intermediate transfer medium for use in electrophotographic image formation, and to an image forming apparatus using the intermediate transfer medium.

2. Discussion of the Background

Recently, various electrophotographic full color image forming apparatus have been commercialized. Among the full color image forming apparatus, double-transfer type image forming methods (hereinafter referred to as intermediate transfer methods) in which color toner images such as yellow, magenta, cyan and black images formed on an image bearing member or plural image bearing members are primarily transferred on an intermediate transfer medium one by one so as to be overlaid, resulting in formation of a full color toner image, and the full color toner image is then secondly transferred to a receiving material are typically used because of having advantages such that images can be formed on various kinds of receiving materials and double-sided copies can be easily produced.

In the image forming apparatus using the intermediate transfer method, various image forming members such as photoreceptors, second transfer rollers, cleaning blades, etc. are contacted with or rubbed by the surface of the intermediate transfer medium while optionally receiving electric stimulation. Therefore, the intermediate transfer medium is required to have good mechanical and electrical resistance. Specifically, the intermediate transfer medium preferably has the following properties:

(1) good abrasion resistance;
(2) good toner releasability;
(3) good surface properties (e.g., friction coefficient); and
(4) good mechanical properties (e.g., linear elasticity and elongation rate).

It has been proposed in published unexamined Japanese Patent Applications Nos. (hereinafter referred to as JP-As) 05-46035, 08-30117, 09-269676, 10-20538 and 11-231678 to use silicone resins and elastomers for an intermediate transfer medium to impart good toner releasability thereto. JP-As 05-311016 and 07-24912 have disclosed polyolefin type intermediate transfer media. However, it is difficult for the techniques to improve the resistance of the intermediate transfer media to abrasion and scratch.

JP-As 05-40417, 06-234903, 07-92825, 08-267605 and 10-166508 have disclosed to use fluorine-containing resins and elastomers for intermediate transfer media to impart good toner releasability thereto. However, the technique has a drawback in that when such materials are used for the outermost layer, the adhesion between the layer and the substrate of the intermediate transfer media deteriorates, resulting in occurrence of a problem in that the outmost layer peels from the substrate.

In addition, other materials such as polycarbonate materials (disclosed in JP-As 06-93175, 06-149081, 06-14908310-10880 and 0.13-31849); polyester materials (disclosed in JP-As 13-13801 and 13-18284); polyurethane materials (disclosed in JP-As 10-319727 and 11-30915); polyimide materials (disclosed in JP-As 07-156287, 08-176319, 11-24427, 11-170389 and 12-172085); and polyimide materials in which a particulate fluorine-containing resin or a fluorine-containing organic compound is dispersed (JP-A 11-156971, 11-119560 and 07-156287), have been proposed. However, the toner releasability of these intermediate transfer media is unsatisfactory. Specifically, a problem in that toner particles and additives of the toner adhere to the surface of the intermediate transfer media tends to occur.

Image forming apparatus using an intermediate transfer method tend to cause a problem in that abnormal images are formed in the primary and second transfer processes depending on the transfer rate of the toner used.

One of the abnormal images is toner scattering. Specifically, the toner scattering problem is such that toner particles in an image are scattered in the primary and/or second transfer processes. More specifically, the toner scattering problem is such that a toner image formed on a photoreceptor is not transferred to a desired position of an intermediate transfer medium and the transferred toner particles are scattered thereabout, resulting in blurring of the resultant toner image and deterioration of sharpness of fine line images.

In attempting to solve such a toner scattering problem, JP-A 63-34570 discloses an image forming method in which an image formed of a toner having a high electric resistance is non-electrostatically transferred onto an intermediate transfer medium, and then the toner image is transferred/fixed to a receiving material using a heat roller upon application of heat and pressure thereto. In addition, JP-A 63-34571 discloses an image forming method in which an image formed of an electroconductive toner is non-electrostatically transferred onto an intermediate transfer medium, and then the toner image is transferred/fixed to a receiving material using a heat roller upon application of heat and pressure thereto. However, these methods have a drawback in that the receiving paper has to be a special receiving material having a high heat resistance so as not to cause a problem when heated by a heat roller. Therefore, the methods do not have the above-mentioned paper-free advantage of the intermediate transfer method.

In attempting to solve the toner scattering problem, JP-A 01-282571 discloses a color image forming apparatus in which whenever toner images are transferred to an intermediate transfer medium, the toner images are discharged using a paper separating charger. In addition, JP-A 02-183276 discloses a full color image forming apparatus in which an intermediate transfer medium is charged so that the transfer voltage in a final color toner image transfer process is higher than that the last color image transfer process in which another color toner image is transferred. Further, JP-A 04-147170 discloses an image forming apparatus in which an intermediate transfer medium is discharged before the toner image on the intermediate transfer medium is transferred on a receiving paper. However, these apparatus have to be equipped with a discharging means or a voltage applicator, and thereby the apparatus become complex in structure and become large in size.

Another of the abnormal images caused when a toner image is transferred is omission. Specifically the omission problem is such that a toner image transferred on an intermediate transfer medium has a pin point omission, wherein the toner image corresponding to the omission remains on the intermediate transfer medium without being transferred.

In attempting to solve this omission problem, JP-A 58-187968 discloses a toner image transfer device in which an organic fluorine-containing compound is applied to the surface of the intermediate transfer medium thereof. In addition, JP-A 02-198476 discloses an image forming apparatus using an intermediate transfer medium including a wettability controlling agent therein. Further, JP-A 02-213881 discloses an image forming apparatus using an intermediate transfer medium having an outermost layer including a lubricant such as zinc stearate. Furthermore, JP-A 03-242667 discloses an image forming apparatus using an intermediate transfer medium which is made of a silicone rubber and which has a surface having a specific surface roughness. JP-A 04-305666 discloses an image forming apparatus in which a contact member which rotates at a speed different from that of the intermediate transfer medium to rub the surface of the intermediate transfer medium. In addition, JP-A 05-307344 discloses an image forming apparatus in which the surface of the intermediate transfer medium thereof is ground when a toner film is formed on the intermediate transfer medium. Further, JP-A 05-313526 discloses an image forming apparatus including a member for rubbing the surface of the intermediate transfer medium thereof if desired after checking the surface roughness of the surface. JP-A 05-323802 discloses an image forming apparatus in which the intermediate transfer medium thereof is rubbed after the predetermined number of copies are produced. However, the omission problem can not be perfectly solved by these techniques.

Because of these reasons, a need exists for an image forming apparatus which uses an intermediate transfer medium and which can produce high quality images without abnormal images such as toner scattering and omission.

SUMMARY OF THE INVENTION

Accordingly, an object of the present invention is to provide an intermediate transfer medium having good surface properties and mechanical properties so as not to cause the toner scattering and omission problems.

Another object of the present invention is to provide an image forming apparatus which uses an intermediate transfer medium and which can produce high quality images without causing the toner scattering and omission problems.

Briefly these objects and other objects of the present invention as hereinafter will become more readily apparent can be attained by an intermediate transfer medium on which a toner image is to be transferred and which has a property such that a surface potential on the intermediate transfer medium decays with time t according to the following equation (1):

$$V=A\exp(-t/\tau) \quad (1)$$

wherein V represents the surface potential of the intermediate transfer medium in absolute value; A is a constant; t is the time; and $\tau$ is a dielectric relaxation time constant, and wherein the dielectric relaxation time constant $\tau$ is less than 1.5 seconds.

The intermediate transfer medium preferably has a specific dielectric constant not greater than 5.5.

The intermediate transfer medium preferably has a capacitance (C) of form 30 to 180 pF/cm$^2$, wherein the capacitance (C) can be determined by the following equation (2):

$$C=Q/V \quad (2)$$

wherein Q represents the charge quantity that the intermediate transfer medium has when the intermediate transfer medium has a surface potential V.

The intermediate transfer medium preferably includes a polyimide resin and/or a resistance controlling agent such as carbon black. It is preferable that carbon black is used in combination with a nonionic surfactant. The polyimide is preferably prepared by reacting a rigid polyamide acid having one phenyl group or plural phenyl groups directly connected with the adjacent phenyl groups with a flexible polyamide acid having plural phenyl groups connected with the adjacent phenyl groups with one or more other functional groups therebetween. The weight ratio (R/F) of the rigid polyamide acid (R) to the flexible polyamide acid (F) is preferably from 7/3 to 2/8.

The intermediate transfer medium is preferably prepared by reacting a film of a mixture of a rigid polyamide acid and a flexible polyamide acid while or after the mixture is coated to prepare the film.

The intermediate transfer medium is preferably a seamless belt. The intermediate preferably has a reinforcing material on the edges thereof.

As another aspect of the present invention, an image forming apparatus is provided which includes:

an image bearing member configured to bear an electrostatic latent image thereon;

a developing device configured to develop the latent image with a developer including a toner to form a toner image on the image bearing member;

an intermediate transfer medium configured to receive the toner image formed on the image bearing member; and a transfer device configured to transfer the toner image on the intermediate transfer medium to a receiving material, wherein the intermediate transfer medium is the intermediate transfer medium mentioned above.

The intermediate transfer medium preferably moves at a linear speed of from 80 to 400 mm/s when toner images are transferred thereon.

The toner preferably has an average circularity of from 0.98 to 1.00, and/or a volume average particle diameter of from 1.0 to 5.0 μm.

The toner is preferably prepared by a method including reacting a compound having an active hydrogen atom with a polymer in an aqueous medium to prepare a particulate material (i.e., mother toner particles) including a binder resin which is the reaction product of the compound and the polymer, and separating the particulate material from the aqueous medium.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
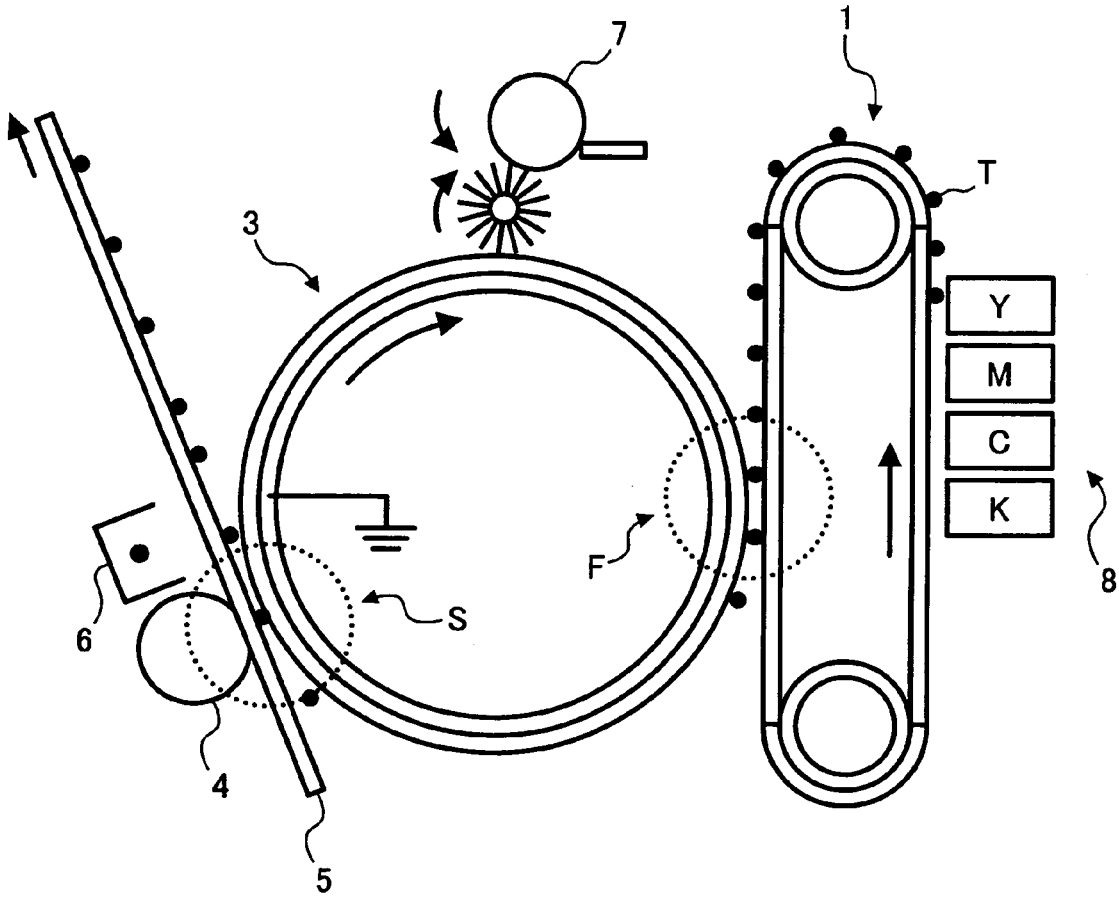
FIG. 1 is a schematic view illustrating the main portion of an example of the image forming apparatus of the present invention.

At first, the intermediate transfer medium of the present invention will be explained in detail.

The structure of the intermediate transfer medium is not particularly limited. However, it is preferable for the intermediate transfer medium to have an outermost layer. Specifically, single-layered structure consisting essentially of an outermost layer whose surface may be subjected to a treatment such as mechanical treatments (e.g., grinding and polishing) and chemical treatments, and multi-layered structure in which an outermost layer is formed on a substrate with or without one or more layers therebetween can be used.

In addition, the form of the intermediate transfer medium is not also particularly limited, and specific examples thereof include drum-form (i.e., cylindrical form) and endless belt form intermediate transfer media.

The intermediate transfer medium of the present invention has a specific dielectric relaxation time constant. The present inventors have analyzed the mechanism of the toner scattering. As a result thereof, it is found that by controlling the transition properties of an electric property (i.e., potential changing property) of the intermediate transfer medium used, the toner scattering problem can be avoided. Specifically, by controlling the time constant in a dielectric relaxation process, the problem can be avoided.

The surface potential V (in absolute value) of the intermediate transfer medium decays with time t according to the following equation (1):

$$V=A\exp(-t/\tau) \quad (1)$$

wherein A is a constant; and $\tau$ is a dielectric relaxation time constant.

In order to avoid the toner scattering problem, the dielectric relaxation time constant $\tau$ is preferably less than 1.5 seconds. When the time constant is too large, the electric field at the transfer position (i.e., a nip between the photoreceptor and the intermediate transfer medium), becomes unstable, thereby causing abnormal discharging, resulting in occurrence of the toner scattering problem.

The dielectric relaxation time constant $\tau$ can be determined by any known methods, but is preferably determined by the following method:

(1) An intermediate transfer medium is charged with a scorotron charger using an electrostatic paper analyzer, EPA-8200 manufactured by Kawaguchi Electric Works, wherein the charging conditions are as follows:

Charging mode: dynamic mode;

Discharge current: 18 μA; and

Charging time: 10 seconds;

(2) after stopping the charging operation, change of the surface potential of the intermediate transfer medium is recorded to obtain a potential decaying curve; and (3) the time constant $\tau$ is determined from the potential decaying curve using equation (1).

The intermediate transfer medium of the present invention preferably has a specific dielectric constant not greater than 5.5. When the specific dielectric constant is too large, the surface potential of the intermediate transfer medium becomes uneven due to increase of the capacitance thereof, thereby causing abnormal discharging, resulting in occurrence of the toner scattering problem.

The specific dielectric constant can be determined by any known methods, but is preferably determined by the following method:

(1) An intermediate transfer medium is charged with a scorotron charger using the electrostatic paper analyzer mentioned above (which has an ampere meter and an electrometer) while checking the total quantity (Q) of the charges during the charging and the surface potential (−V) of the intermediate transfer medium;

(2) the capacitance (C) of the intermediate transfer medium is determined from the slope of beginning (i.e., charge starting portion) of the surface potential curve using an equation (2)

$$C=Q/V \text{ and}$$

(3) the specific dielectric constant $\in r$ is determined by the following equation (3):

$$C=(\in r\cdot\in 0\cdot S)/d \quad (3)$$

wherein $\in 0$ represents the vacuum dielectric constant (i.e., $8.854\times10^{-12}$ A·s/V·m), S represents the area of the charged portion of the intermediate transfer medium, and d represents the thickness of the outermost layer (or the intermediate transfer medium).

The intermediate transfer medium of the present invention preferably has a capacitance (C) (per unit area) of from 30 to 180 pF/cm$^2$. When the capacitance (C) is too small, the intermediate transfer medium tends to cause dielectric breakdown and thereby the toner scattering problem is caused. In contrast, when the capacitance (C) is too large, the surface potential becomes uneven due to increase of the capacitance, resulting in occurrence of the toner scattering problem.

The capacitance (C) can be determined by the method mentioned above for use in determining the specific dielectric constant using equation (2).

JP-A 2003-177610 discloses a technique in that the dielectric relaxation time constant is controlled to be from 0.01 to 1000 seconds. However, a polyvinylidene fluoride resin is used for the intermediate transfer medium in Examples of the application publication. When a polyvinylidene fluoride resin, which typically has a specific dielectric constant not less than 10 and a resistivity of from $10^{12}$ to $10^{13}$ Ω·cm, the capacitance (per unit area) of the resultant intermediate transfer medium has to be from few to tens femto coulomb. In this case, the thickness of the intermediate transfer medium has to be not less than 1 meter. It is impossible to use an intermediate transfer medium having such a thickness.

In addition, it is described in the application publication that the properties of an intermediate transfer medium depend on only the time constant thereof or a combination of the time constant and the resistivity thereof. However, it is difficult to prevent occurrence of the abnormal images mentioned above by controlling only the time constant or a combination of the time constant and the resistivity so as to fall specific ranges, and it is necessary to control the time constant, and dielectric constant (or capacitance) thereof. The reason why the technique disclosed in JP-A 2003-177610 cannot solve the problems is considered to be that although the time constant, which changes depending on frequency, is a dynamic property, the resistivity, which is measured using a DC voltage, is a static property. Namely, such a static factor cannot be an important factor affecting such dynamic phenomena mentioned above. In the present invention, the time constant and specific dielectric constant (or capacitance), both of which are dynamic properties, are controlled, and thereby the above-mentioned problems can be solved.

The moving speed (i.e., surface linear velocity) of the intermediate transfer medium in the image transferring process is not particularly limited, but is preferably from 80 to 400 mm/s. When the surface linear velocity is too high, the intermediate transfer medium cannot follow the rapid change of transfer bias application/nonapplication operation (this is because the intermediate transfer medium is rotated and is applied with a transfer bias at a certain point), and thereby the intermediate transfer medium stores undesired charges. Therefore, the electric field cannot be well formed in the transfer process, and thereby the toner scattering problem occurs. In contrast, when the surface linear velocity is too low, discharging tends to occur, and thereby abnormal images such as omissions tend to be produced. In addition, high speed image formation cannot be performed.

The intermediate transfer medium of the present invention preferably has an outermost layer. The outermost layer preferably has the above-mentioned electric properties. A polyimide resin is preferably included in the outermost layer to impart good surface properties and mechanical properties to the intermediate transfer medium. The outermost layer can include other components, if desired.

Any known polyimide resins can be used for the intermediate transfer medium, but polyimide resins which have the below-mentioned formula (1) and which are prepared by subjecting an aromatic polycarboxylic acid anhydride or derivative thereof and an aromatic diamine to a condensation reaction are preferably used. It is more preferable to use polyimide resins which are prepared by reacting a rigid polyamide acid having a phenyl group or a phenyl group chain, in which a phenyl group is directly connected with the adjacent phenyl groups, with a flexible polyamide acid having plural phenyl groups connected with the adjacent phenyl groups with another functional group therebetween is preferably used as the polyimide.

Polyamide acids are typically prepared by reacting an aromatic polycarboxylic acid anhydride or its derivative with an aromatic diamine (i.e., condensation reaction). The reaction formula is as follows:

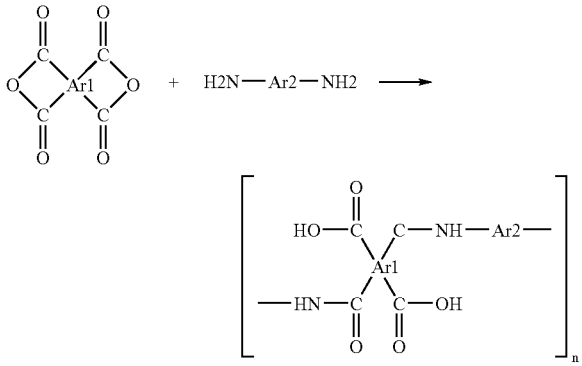

(Polyamide acid)

When the group $Ar_2$ is a phenyl group or a phenyl group chain in which plural phenyl groups are chained with no other group therebetween, the resultant polyamide acid is a rigid polyamide acid. In contrast, when the group $Ar_2$ is a group in which plural phenyl groups are chained with one or more other groups therebetween, the resultant polyamide acid is a flexible polyamide acid.

When the thus prepared polyamide acid is subjected to molding or coating, followed by dehydration/cyclization treatment (i.e., formation of a polyimide) upon application of heat or using a chemical method. The process is as follows.

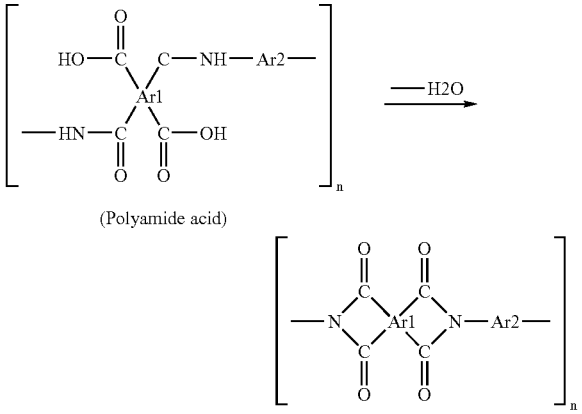

(Polyamide acid)

(Polyimide)

In the formula, $Ar_1$ represents a tetravalent aromatic group including at least one six-carbon ring; and $Ar_2$ represents a divalent aromatic group.

Specific examples of the aromatic polycarboxylic acid anhydrides include ethylenetetracarboxylic acid dihydride, cyclopentanetetracarboxylic acid dihydride, pyromellitic acid dihydride, 3,3',4,4'-benzophenonetetracarboxylic acid dihydride, 2,2',3,3'-benzophenonetetracarboxylic acid anydride, 3,3',4,4'-biphenyltetracarboxylic acid dihydride, 2,2',3,3'-biphenyltetracarboxylic acid dihydride, 2,2-bis(2,3-dicarboxyphenyl)propane dihydride, bis(3,4-dicarboxyphenyl)ether dihydride, bis(3,4-dicarboxyphenyl) sulfone dihydride, 1,1-bis(2,3-dicarboxyphenyl)ethane dihydride, bis(2,3-dicarboxyphenyl)methane dihydride, bis (3,4-dicarboxyphenyl)methane dihydride, 2,2-bis(3,4-dicarboxyphenyl)-1,1,1,3,3,3-hexafluoropropane dihydride, 2,3,6,7-naphthalenetetracarboxylic acid dihydride, 1,4,5,8-naphthalenetetracarboxylic acid dihydride, 1,2,5,6-naphthalenetetracarboxylic acid dihydride, 1,2,3,4-benzenetetracarboxylic acid dihydride, 3,4,9,10-perylenetetracarboxylic acid dianhydride, 2,3,6,7-anthracenetetracarboxylic acid dianhydride, 1,2,7,8-phenanthreneteracarboxylic acid dihydride, etc. These compounds can be used alone or in combination.

Specific examples of the aromatic diamine compounds having a phenyl-group or a phenyl group chain with no other groups therebetween include m-phenylenediamine, o-phenylenediamine, p-phenylenediamine, 4,4'-diaminobisphenyl, 3,3'-diaminobisphenyl, etc.

Specific examples of the aromatic diamine compounds having plural phenyl groups with one or more other groups therebetween include 4,4'-diaminodiphenyl ether, 3,3'-diaminodiphenyl ether, 3,4'-diaminodiphenyl ether, 3,3'-diaminobenzophenone, 3,4'-diaminobenzophenone, 4,4'-diaminobenzophenone, m-aminobenzylamine, p-aminobenzylamine, 3,3'-diaminodiphenylmethane, 3,4'-diaminodiphenylmethane, 4,4'-diaminodiphenylmethane, bis(3-aminophenyl)sulfide, (3-aminophenyl)(4-aminophenyl)sulfide, bis(4-aminophenyl)sulfide, bis(3-aminophenyl) sulfide, (3-aminophenyl)(4-aminophenyl)sulfoxide, bis(3-aminophenyl)sulfone, (3-aminophenyl)(4-aminophenyl) sulfone, bis(4-aminophenyl)sulfone, bis[4-(3-aminophenoxy)phenyl]methane, bis[4-(4-aminophenoxy) phenyl]methane, 1,1-bis[4-(3-aminophenoxy)phenyl] ethane, 1,1-bis[4-(4-aminophenoxy)phenyl]ethane, 1,2-bis [4-(3-aminophenoxy)phenyl]ethane, 1,2-bis[4-(4-aminophenoxy)phenyl]ethane, 2,2-bis[4-(3-aminophenoxy) phenyl]propane, 2,2-bis[4-(4-aminophenoxy)phenyl] propane, 2,2-bis[4-(3-aminophenoxy)phenyl]butane, 2,2-bis [3-(3-aminophenoxy)phenyl]-1,1,1-3,3,3-hexafluoropro pane, 2,2-bis[4-(4-aminophenoxy)phenyl]-1,1,1-3,3,3-hexafluoropro pane, 1,3-bis(3-aminophenoxy)benzene, 1,3-bis(4-aminophenoxy)benzene, 1,4-bis(3-aminophenoxy) benzene, 1,4-bis(4-aminophenoxy)benzene, 4,4'-bis(3-aminophenoxy)biphenyl, 4,4'-bis(4-aminophenoxy) biphenyl, bis[4-(3-aminophenoxy)phenyl]ketone, bis[4-(4-aminophenoxy)phenyl]ketone, bis[4-(3-aminophenoxy) phenyl]sulfide, bis[4-(4-aminophenoxy)phenyl]sulfide, bis [4-(3-aminophenoxy)phenyl]sulfoxide, bis[4-(4-aminophenoxy)phenyl]sulfoxide, bis[4-(3-aminophenoxy) phenyl]sulfone, bis[4-(4-aminophenoxy)phenyl]sulfone, bis [4-(3-aminophenoxy)phenyl]ether, bis[4-(4-aminophenoxy) phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenylether, 4,4'-bis[3-(3-aminophenoxy)benzoyl]diphenylether, 4,4'-bis[4-(4-amino-α,α-dimethylbenzyl)phenoxy]benzophenone, 4,4'-bis[4-(4-amino-α,α-dimethylbenzyl)phenoxy]diphenylsulfone, bis [4-{4-(4-aminophenoxy)phenoxy}phenyl]sulfone, 1,4-bis [4-{4-(4-aminophenoxy)phenoxy}-α,α-dimethylbenzyl] benzene, 1,3-bis[4-(4-aminophenoxy)-α,α-dimethylbenzyl] benzene, etc. These compounds are used alone or in combination.

The mixing ratio (R/F) of a rigid polyamide acid (R) to a flexible polyamide acid (F) is preferably from 7/3 to 2/8 by weight. More preferably, the ratio is from 7/3 to 5/5 because when a rigid component is included in a relatively large amount, the specific dielectric constant can be easily controlled so as to fall within the desired range mentioned above while controlling the time constant.

Polyimide resins prepared by a rigid polyamide acid have high strength (high stiffness) but has brittleness (i.e., poor flexibility). In contrast, polyimide resins prepared by a rigid polyamide acid have slightly low strength but has good flexibility.

By using a polyimide resin, which is prepared by subjecting a rigid polyamide acid and a flexible polyamide acid to a reaction (dehydration reaction), the resultant intermediate transfer medium has high rigidity and good flexibility.

The polyimide resin can be prepared by various methods, but the following method is preferably used.

At first, one or more carboxylic acid anhydrides and one or more aromatic diamines mentioned above (together with other components if desired) are dissolved in a non-protonic polar solvent such as N-methyl-2-pyrrolidone, dimethylformamide, dimethylacetamide, dimethylsulfoxide, dimethylimidazoline, and hexamethylphosphoramide. Then the solution is heated to a temperature of from 40 to 80° C. while agitated to prepare a polyamide acid which is a precursor of a polyimide resin.

The thus prepared polyamide acid is dissolved in a solvent to prepare a polyimide forming varnish having proper solid content and viscosity. Specific examples of the solvent include amides such as N-methylpyrrolidone, N,N-dimethylformaide, and N,N-dimethylacetamide; polyamic solvens such as γ-butyrolactone, bipolar solvents, ethyl lactate, methoxymethyl propionate, propylene glycol monomethyl ether acetate, etc.

The added amount of the solvent is not particularly limited, but is typically from 250 to 2,000 parts by weight per 100 parts by weight of the polyamide acid. Namely, it is preferable to control the solid content of the polyimide forming varnish to be from 5 to 30% by weight.

Then the polyimide forming varnish is heated so that the polyamide acid is dehydrated. Thus, a polyimide resin is prepared.

The heating temperature is preferably from 100 to 400° C., and more preferably from 250 to 350° C.

The intermediate transfer medium of the present invention can include other components such as resistivity controlling agents, organic materials (e.g., resins) and inorganic materials (e.g., fillers).

As for the resistivity controlling agents, any known materials which can adjust the resistivity of the intermediate transfer medium can be used. Specific examples of the resistivity controlling agents include inorganic materials such as carbon blacks (e.g., KETJEN BLACK and acetylene black), metal powders (e.g., Ni powders), metal oxides (e.g., tin oxide, titanium oxide, aluminum oxide and zinc oxide), and metal oxides doped with another atom (e.g., antimony) and organic materials such as organic compounds having a group such as quaternary ammonium, carboxyl, sulfonic acid, sulfate and phosphate groups; polymers of the organic compounds, polymers of the organic compounds (e.g., ether ester amide polymers, ether amide imide polymers, ethylene oxide—epihalohydrin copolymers, compounds having an electroconductive unit such as methoxypolyethylene glycol acrylate and their polymers, etc.

When carbon blacks, metal powders and metal oxides are used, the surface thereof is preferably treated with a surface treatment agent such as surfactants, to avoid the toner scattering problem. Suitable surfactants include known surfactants such as nonionic, anionic and cationic surfactants.

Suitable nonionic surfactants include oligomers having an lipophilic group such as long chain alkyl, alkene and alkoxyl groups, alkylene oxide adducts, etc.

Suitable cationic surfactants include quaternary ammonium salts having an alkyl group.

Suitable anionic surfactants include monovalent metal salts of sulfonic acids and carboxylic acids having a group such as long chain alkyl, alkene and alkoxyl groups, and phosphoric acid esters.

By being treated with a surfactant, the inorganic materials have a function of dispersant, and as a result the materials have good affinity for the polyimide resin. Therefore, the resultant intermediate transfer medium (outermost layer) secures a transfer current passage through which transfer current is stably flows.

Among these resistivity controlling agents, carbon blacks are preferably used because of being well balanced in view of function and cost. When carbon blacks are used as the resistivity controlling agent, nonionic surfactants are preferably used for the surface treatment. This is because the resultant intermediate transfer medium (outermost layer) secures a transfer current passage through which transfer current is stably flows. Therefore, the toner scattering problem can be avoided. When cationic or anionic surfactants are used in combination with carbon blacks, ions included therein serve as space charges, thereby causing a problem in that abnormal current flows locally through the resultant intermediate transfer medium, resulting in occurrence of toner scattering.

The present inventors consider that the above-mentioned space charges and local abnormal current flow cause abnormal images such as toner scattering and omission. In order to avoid the problems, the time constant and the specific dielectric constant are controlled so as to fall the above-mentioned ranges. In this regard, it is important to select a proper dispersant (surfactant) to stably control the time constant and the specific dielectric constant.

Specific examples of the nonionic surfactants include nonionic surfactants based on higher alcohols, polyoxyalkylene glycols, fatty acid esters, fatty acid ethylene oxides, ethylene oxide adducts of fatty acid methyl esters, alkyl amines, alkyl diamines, ethylene oxide adducts of alkylamides, alkylamine oxides, etc.

Specific examples of the organic materials for use in the intermediate transfer medium include resins such as alkyd resins, chlorinated polyether resins, chlorinated polyethylene resins, epoxy resins, fluorine-containing resins, phenolic resins, polyamide resins, polycarbonate resins, polyethylene resins, methacrylic resins, polypropylene resins, polystyrene resins, polyurethane resins, polyvinyl chloride resins, polyvinylidene chloride resins, silicone resins, etc.

Specific examples of the inorganic materials for use in the intermediate transfer medium include fillers such as glass, titanium oxide, silica, etc., which are added to reinforce the intermediate transfer medium.

The method for adding these other components is not particularly limited. For example, a method in which a solution or dispersion of the components is added to the polyimide forming varnish, or a method in which a particulate material is directly added to the polyimide forming varnish can be used.

As mentioned above, the structure and form of the intermediate transfer medium of the present invention are not particularly limited, and single-layered structure and multi-layered structure are available, and drum form and endless belt form are available. In the multi-layered structure, a substrate is preferably used to support the outermost layer.

The substrate is not particularly limited. When a cylindrical substrate is used, metals such as stainless steels (SUS) and aluminum are preferably used. Suitable materials for use as the substrate of the endless belt include elastomers such as electroconductive rubbers, urethane rubbers, and amorphous polyester resins.

When an elastomer is used as the substrate, flexibility can be imparted to the resultant intermediate transfer medium, resulting in prevention of occurrence of omission.

The intermediate transfer medium of the present invention preferably has a reinforcing material on the edges thereof, to improve the durability thereof. Specifically, occurrence of cracks on the edges, which results in breakage of the intermediate transfer medium, can be prevented.

Suitable materials for use as the reinforcing material include inorganic reinforcing materials such as metal plates and ceramic plates; reinforcing resin materials such as resin plates or tapes having an adhesive layer thereon; etc. Among these materials, adhesive tapes such as cellulose based adhesive tapes, polyvinyl chloride based adhesive tapes, and PTFE based adhesive tapes are preferably used. By adhering these tapes on the edges of the intermediate transfer medium, the durability thereof can be improved. This is a simple method for improving the durability of the intermediate transfer medium.

The method for preparing the intermediate transfer medium of the present invention is not particularly limited.

In order to prepare a single-layered intermediate transfer medium, the materials mentioned above for use in the outermost layer are molded so as to be an endless belt. In order to prepare a multi-layered intermediate transfer medium, an outer most layer is formed on a substrate.

Specifically, a solution including a rigid polyamide acid and a flexible polyamide acid is molded or coated on a substrate, followed by heating to prepare a polyimide film. The operation of heating the polyamide acids can be performed during or after the film forming process.

When a multi-layered intermediate transfer medium is prepared, the following method is typically used.

At first, a polyimide forming varnish including a rigid polyamide acid and a flexible polyamide acid is dissolved or dispersed in a solvent to prepare a coating (molding) liquid. In this case, it is also possible to mix a polyimide forming varnish including a rigid polyamide acid and another polyimide forming varnish including a solution of a flexible polyamide acid.

Specific examples of the solvents include N-methyl-2-pyrrolidone, N,N-dimethylacetamide, N,N-dimethylformamide, dimethylsulfoxide, sulforane, hexamethylphosphoric acid triamide, 1,3-dimethyl-2-imidazolidone, hexane, benzene, toluene, xylene, methyl ethyl ketone, acetone, diethyl ether, tetrahydrofuran, dioxane, 1,2-dimethoxymethane, diethylene glycol, dimethyl ether, methyl cellosolve, cellosolve acetate, methanol, ethanol, propanol, isopropanol, methyl acetate, ethyl acetate, acetonitrile, methylene chloride, chloroform, carbon tetrachloride, chlorobenzene, dichlorobenzene, dichloroethane, trichloroethane, etc.

The solid content of the polyimide forming varnish is preferably from 0.1 to 60% by weight, more preferably from 1 to 50% by weight, and even more preferably from 5 to 45% by weight.

The thus prepared coating liquid is then coated on a substrate. The coating method is not particularly limited, and known coating methods such as knife coating, blade coating, bar coating, roll coating, spray coating, brush coating, spin coating and dip coating can be used.

When an outermost layer having a desired thickness cannot be prepared by only one coating operation, two or more coating operations are performed so that the resultant overlaid plural layers have the desired thickness.

The thus coated liquid is then heated to a predetermined temperature of, preferably, from 100 to 40° C. and more preferably from 250 to 350° C., to form a polyimide film on the substrate.

Then the method for preparing a single-layered intermediate transfer medium will be explained.

Suitable methods for use in preparing single-layered intermediate transfer medium include the following centrifugal molding method in which an endless belt is formed using the above-prepared polyimide forming varnish, but are not limited thereto.

Specifically, at first a polyimide forming varnish is dissolved or dispersed in a solvent to prepare a molding liquid. In this regard, the solvents mentioned above can also be used, and the solid content of the resultant liquid is similar to that mentioned above.

The thus prepared molding liquid is fed into a cylindrical molding machine which is rotated at a high speed, resulting in formation of an endless film. The thus prepared endless film is then heated to a predetermined temperature to prepare an endless polyimide film (i.e., an endless intermediate transfer belt). As mentioned above, the temperature is preferably from 100 to 400° C. and more preferably from 250 to 350° C. By using this centrifugal molding method, an endless belt having a uniform thickness can be prepared.

Then the developer for use in developing electrostatic latent images formed on the image bearing member of the present invention will be explained. Developer is broadly classified into one component developers essentially consisting of a toner, and two component developers including a toner and a developer.

At first, the toner for use in the image forming apparatus of the present invention will be explained.

Any know toners can be used for the image forming apparatus of the present invention. However, in order to prevent occurrence of omission, a spherical toner having a relatively small volume average particle diameter is preferably used.

When a spherical toner having a small particle diameter is used in combination with a conventional intermediate transfer medium, the toner scattering problem tends to occur. However, the intermediate transfer medium of the present invention does not cause the toner scattering problem even when a spherical toner having a small particle diameter is used in combination therewith. This is because movement of the toner particles is prevented on the intermediate transfer medium of the present invention. Therefore, high quality images without toner scattering and omission can be stably produced.

It is preferable to use a spherical toner having an average circularity of from 0.90 to 1.00, and preferably from 0.98 to 1.00, for the image forming apparatus of the present invention. In this regard, it is preferable for the toner to include toner particles having a circularity less than 0.90 in an amount less than 30%.

In the present application, the circularity of a toner is determined by the following method using a flow-type particle image analyzer FPIA-1000 from Sysmex Corp.:

(1) a suspension including toner particles to be measured is passed through a detection area formed on a plate in the measuring instrument; and (2) the particles are optically detected by a CCD camera and then the shapes thereof are analyzed with an image analyzer.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

When the average circularity of the toner is less than 0.90, there is a case in which high quality images without omission and toner scattering cannot be produced.

The volume average particle diameter of the toner is preferably from 1.0 to 8.0 μm, and more preferably from 1.0 to 5.0 μm. When the volume average particle diameter is too small, the toner tends to adhere to the surface of carrier particles when agitated in a developing device for a long period of time, thereby deteriorating the charging ability of the carrier, resulting in deterioration of image qualities. When such a small particle diameter toner is used as a one component developer, the toner tends to adhere to developing rollers and blades used for forming a toner layer on the developing rollers, resulting in deterioration of image qualities. In contrast, when the volume average particle diameter is too large, high definition images cannot be produced. In this case, a problem in that the particle diameter distribution of the toner varies occurs when the toner is used for a long period of time while replenished to the developing device tends to occur.

The ratio (Dv/Dn) of the volume average particle diameter (Dv) of the toner to the number average particle diameter (Dn) thereof is preferably from 1.00 to 1.25, and more preferably from 1.10 to 1.25. When the ratio is too small, the toner tends to adhere to the surface of carrier particles when agitated in a developing device for a long period of time, thereby deteriorating the charging ability of the carrier, resulting in deterioration of image qualities. When such a small particle diameter toner is used as a one component developer, the toner tends to adhere to developing rollers and blades used for forming a toner layer on the developing rollers, resulting in deterioration of image qualities. In contrast, when the ratio (Dv/Dn) is too large, it becomes difficult to produce high quality and high definition images, and a problem in that the particle diameter distribution of the toner varies occurs when the toner is used for a long period of time while replenished to the developing device.

The volume average particle diameter (Dv), and the ratio (Dv/Dn) of a toner can be measured using a particle diameter measuring instrument such as MULTISIZER II from Beckmann Coulter.

The specific surface area of the boner is preferably from 0.5 to 8.0 $m^2/g$, and more preferably from 0.5 to 7.5 $m^2/g$, when measured by a BET method.

When the specific surface area is too small, the particulate resins present on the surface of the toner particles tend to cover the entire surface of the toner particles, and thereby the adhesion of the binder resin in the toner particles and receiving materials is deteriorated, resulting in increase of the minimum fixable temperature. In contrast, when the specific surface area is too large, the release agent (such as waxes) included in inner portions of the toner particles is prevented from exuding, thereby causing an offset problem in which a portion or entire of toner images on a receiving sheet adheres to a fixing roller, and the transferred images are re-transferred to another portion of the sheet or another sheet.

The BET surface area can be determined using a surface area measuring instrument TRISTAR 3000 from Shimadzu Corp. The method is such that a nitrogen gas is adsorbed on the sample and the surface area is determined using a BET multi-point method.

The spherical toner having a small volume average particle diameter is preferably prepared by a method including reacting a compound having an active hydrogen atom with a polymer in an aqueous medium to prepare a particulate material including a binder resin (i.e., the reaction product of the compound and the polymer); and separating the particulate material from the aqueous medium.

Then constituents of the toner will be explained in detail.

The toner includes an adhesive material which has good adhesiveness against various receiving materials. The adhesive material includes a binder resin which is prepared by reacting a polymer with a compound having an active hydrogen atom in an aqueous medium to crosslink and/or extend the polymer, and optionally one or more other binder resins selected from known binder resins. The adhesive material preferably has a weight average molecular weight not less than 1,000, more preferably from 2,000 to 10,000,000, and even more preferably from 3,000 to 1,000,000. When the weight average molecular weight is too low, the toner has poor hot offset resistance.

The adhesive material preferably has a glass transition temperature (Tg) of from 30 to 70° C., and more preferably from 40 to 65° C. Since the adhesive material includes a crosslinked and/or extended polymer such as polyester resins, the resultant toner has better preservability than conventional toners even when the toner has a relatively low glass transition temperature compared to those of the conventional toners. However, when the Tg is too low, the toner has poor preservability. In contrast, when the Tg is too high, the low temperature fixability of the toner deteriorates.

The glass transition temperature (Tg) of a resin can be measured with a TG-DSC System TAS-100 from Rigaku Corporation. The method is as follows.

(1) about 10 mg of a sample which is contained in an aluminum container is set on a holder unit, and the holder unit is set in an electric furnace;

(2) the sample is heated from room temperature to 150° C. at a temperature rising speed of 10° C./min, followed by heating at 150° C. for 10 minutes and cooling to room temperature; and (3) after the sample is allowed to settle at room temperature for 10 minutes, the sample is heated again from room temperature to 150° C. at a temperature rising speed of 10° C./min to obtain a DSC curve.

The glass transition temperature (Tg) of the sample is determined using an analyzing system of TAS-100. The glass transition temperature is defined as the temperature at which the tangent line of the endothermic curve crosses the base line.

Known resins and the like materials can be used for the adhesive material. Among the materials, polyester resins are preferably used.

Among polyester resins, urea-modified polyester resins are more preferably used.

Urea-modified polyester resins are prepared by reacting an amine (i.e., a compound having an active hydrogen) with a polyester prepolymer having an isocyanate group (i.e., the polymer capable of reacting with an active hydrogen) in an aqueous medium.

The urea-modified polyester resins can include a urethane bonding. The molar ratio (U1/U2) of the urea bonding (U1) to the urethane bonding (U2) is from 100/0 to 10/90, preferably from 80/20 to 20/80 and more preferably from 60/40 to 30/70. When the content of the urea bonding is too low, the hot offset resistance of the toner deteriorates.

Specific examples of suitable urea-modified polyester resins include the following.

(1) Mixtures of a urea-modified polyester resin which is prepared by reacting a polyester prepolymer, which is prepared by reacting a polycondensation product of an ethylene oxide (2 moles) adduct of bisphenol A and isophthalic acid with isophorone diisocyanate, with isophorone diamine; and a polycondensation product of an ethylene oxide (2 moles) adduct of bisphenol A and isophthalic acid;

(2) Mixtures of a urea-modified polyester resin which is prepared by reacting a polyester prepolymer, which is prepared by reacting a polycondensation product of an ethylene oxide (2 moles) adduct of bisphenol A and isophthalic acid with isophorone diisocyanate, with isophorone diamine; and a polycondensation product of an ethylene oxide (2 moles) adduct of bisphenol A and terephthalic acid;

(3) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A and terephthalic acid with isophorone diisocyanate, with isophorone diamine; and a polycondensation product of an ethylene oxide (2 moles) adduct of bisphenol A, a propyleneoxide (2 moles) adduct of bisphenol A and terephthalic acid;

(4) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A and terephthalic acid with isophorone diisocyanate, with isophorone diamine; and a polycondensation product of a propylene oxide (2 moles) adduct of bisphenol A and terephthalic acid;

(5) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with hexamethylene diamine; and a polycondensation product of an ethylene oxide (2 moles) adduct of bisphenol A and terephthalic acid;

(6) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with hexamethylene diamine; and a polycondensation product of an ethylene oxide (2 moles) adduct of bisphenol A, a propylene oxide (2 moles) adduct of bisphenol A and terephthalic acid;

(7) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with ethylene diamine; and a polycondensation product of an ethylene oxide (2 moles) adduct of bisphenol A and terephthalic acid;

(8) Mixtures of a urea-modified polyester resin which is prepared by reacting a polyester prepolymer, which is prepared by reacting a polycondensation product of an ethylene oxide (2 moles) adduct of bisphenol A and isophthalic acid with diphenylmethane diisocyanate, with hexamethylene diamine; and a polycondensation product of an ethylene oxide (2 moles) adduct of bisphenol A and isophthalic acid;

(9) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A, terephthalic acid and dodecenyl succinic anhydride with diphenylmethane diisocyanate, with hexamethylene diamine; and a polycondensation product of an ethylene oxide (2 moles) adduct of bisphenol A, a propylene oxide (2 moles) adduct of bisphenol A and terephthalic acid; and

(10) Mixtures of a urea-modified polyester resin which is prepared by reacting a polyester prepolymer, which is prepared by reacting a polycondensation product of an ethylene oxide (2 moles) adduct of bisphenol A and isophthalic acid with tolylene diisocyanate, with hexamethylene diamine; and a polycondensation product of an ethylene oxide (2 moles) adduct of bisphenol A and isophthalic acid.

The compound having an active hydrogen is used for crosslinking and/or extending the polymer capable of reacting with a compound having an active hydrogen. Namely, the compound serves as a crosslinking agent and/or an extending agent.

Known compounds having an active hydrogen can be used as the compound and one ore more proper compounds are chosen and used for the toner. For example, when an polyester prepolymer having an isocyanate group is used, amines are preferably used as the compound having an active hydrogen because the extension reaction and/or the crosslinking reaction can be easily performed and thereby a polymer having high molecular weight can be easily produced.

Specific examples of the groups having an active hydrogen include hydroxyl groups (alcoholic hydroxyl groups and phenolic hydroxyl groups), amino groups, carboxyl groups, mercapto groups, etc. Compounds having two or more of these groups can also be used, and combinations of a compound having one of the groups and another compound having another of the groups can also be used. Among these groups, alcoholic hydroxyl groups are preferable.

Specific examples of the amines (B) include diamines (B1), polyamines (B2) having three or more amino groups, amino alcohols (B3), aminomercaptans (B4), amino acids (B5) and blocked amines (B6) in which the amines (B1–B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (5) include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., an equivalence ratio [NCO]/[NHx]) of (the [NCO] of) the prepolymer (A) having an isocyanate group to (the [NHx] of) the amine (B) is from 1/3 to 3/1, preferably from 1/2 to 2/1 and more preferably from 1/1.5 to 1.5/1. When the mixing ratio is too low or too high, the molecular weight of the resultant urea-modified polyester decreases, resulting in deterioration of the hot offset resistance of the resultant toner.

Any known polymers having a group which can be reacted with a compound having an active hydrogen can be used as the polymer (hereinafter referred to as a prepolymer). Specific examples of the polymers include polyol resins, acrylic resins, polyester resins, epoxy resins, and derivatives thereof. These resins can be used alone or in combination. Among these resins, polyester resins are preferable.

Specific examples of the group of the prepolymer which can be reacted with an active hydrogen include isocyanate groups, epoxy groups, carboxyl groups, acid chloride groups, etc. Compounds having two or more of the groups and combinations of a compound having one of the groups and another compound having another of the groups can also be used. Among these groups, isocyanate groups can be preferably used.

Among the prepolymers, polyester resins (RMPE) having a group which can produce a urea bonding are preferably used because (1) the molecular weight of the resultant polymers can be easily controlled; and (2) the resultant toner can be used for oil-less low temperature fixing devices without causing the offset problem.

Specific examples of the group which can produce a urea bonding include isocyanate groups.

Polyester prepolymers having an isocyanate group can be prepared by reacting a polycondensation product of a polyol (PO) and a polycarboxylic acid (PC) with a polyisocyanate (PIC).

Suitable polyols (PO) include diols (DIO), polyols (TO) having three or more hydroxyl groups, and mixtures of DIO and TO. Preferably, diols (DIO) or mixtures of a small amount of a polyol (TO) with a diol (DIO) are used.

Specific examples of the diols (DIO) include alkylene glycols, alkylene ether glycols, alicyclic diols, alkylene oxide adducts of alicyclic dials, bisphenols, alkylene oxide adducts of bisphenols.

Suitable alkylene glycols include alkylene glycols having 2 to 12 carbon atoms, e.g., ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic dials include 1,4-cyclohexane dimethanol and hydrogenated bisphenol A. Specific examples of the alkylene oxide adducts of alicyclic diols include adducts of the alicyclic dials mentioned above with an alkylene oxide (e.g., ethylene oxide, propylene oxide and butylene oxide). Specific examples of the bisphenols include bisphenol A, bisphenol-F and bisphenol S. Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

When mixtures of a diol (DIO) and a polyol (TO) are used, the weight ratio (DIO/TO) is preferably 100/0.01 to 100/10, and more preferably from 100/0.01 to 100/1.

Suitable polycarboxylic acids (PC) include dicarboxylic acids (DIC) and polycarboxylic acids (TC) having three or more carboxyl groups. Preferably, dicarboxylic acids (DIC) or mixtures of a small amount of a polycarboxylic acid (TC) with a dicarboxylic acid (DIC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

When combinations of a dicarboxylic acid and a polycarboxylic acid (TC) are used, the weight ratio (DIC/TC) is preferably 100/0.01 to 100/10, and more preferably from 100/0.01 to 100/1.

Suitable mixing ratio (i.e., an equivalence ratio [OH]/[COOH]) of (the [OH] of) a polyol (PO) to (the [COOH] of) a polycarboxylic acid (PC) is from 2/1 to 1/1, preferably from 1.5/1 to 1/1 and more preferably from 1.3/1 to 1.02/1. When the ratio is too high or too low, a problem in that the polycondensation reaction does not well proceed tends to occur.

The content of the polyol unit in the polyester prepolymer (A) is preferably from 0.5 to 40% by weight, more preferably from 1 to 30% by weight, and even more preferably from 2 to 20% by weight. When the content is too low, the hot offset resistance deteriorates and a good combination of preservability and low temperature fixability cannot be imparted to the toner. When the content is too high, the low temperature fixability of the toner deteriorates.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha,\alpha,\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination. Among these compounds, isophorone diisocyanate is preferable.

Suitable mixing ratio (i.e., an equivalence ratio [NCO]/[OH]) of (the [NCO] of) a polyisocyanate (PIC) to (the [OH] of) a polyester is from 5/1 to 1/1, preferably from 4/1 to 1.2/1 and more preferably from 3/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates.

The content of the polyisocyanate (PIC) unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the toner. In contrast, when the content is too high, the low temperature fixability of the toner deteriorates.

The number of the isocyanate group included in a molecule of the polyester prepolymer (A) is not less than 1, preferably from 1.2 to 5, and more preferably from 1.5 to 4. When the number of the isocyanate group is too small, the molecular weight of the resultant urea-modified polyester decreases and thereby the hot offset resistance deteriorate.

The reaction of a polymer with a compound having an active hydrogen is performed in an aqueous medium.

Suitable aqueous media for use in preparing toner particles include water, other solvents which can be mixed with water, and mixtures thereof. Specific examples of the solvents which can be mixed with water include alcohols such as methanol, isopropanol, and ethylene glycol; dimethylformamide, tetrahydrofuran, cellosolves such as methyl cellosolve, lower ketones such as acetone and methyl ethyl ketone, etc.

The toner of the present invention can include other components such as colorants, release agents, resins (such as unmodified polyester resins) other than the above-mentioned resins, charge controlling agents, fluidity improving agents, cleanability improving agents, magnetic materials, metal soaps, external additives (such as particulate inorganic materials), etc.

Known dyes and pigments can be used as the colorant of the toner and one or more proper dyes and pigments (such as yellow, magenta, cyan and black dyes and pigments) are chosen and used for the toner.

The toner preferably includes a particulate material as an external additive, to avoid the omission problem. To add an external additive to the toner particles prevents the toner particles from having excessively high non-electrostatic adhesiveness against the image bearing members such as intermediate transfer medium and photoreceptor. In this case, it is preferable to select a proper external additive and determine the particle diameter and covering ratio (i.e., the ratio of the area of the surface of toner particles covered with an external additive to the total surface area).

Specific examples of such materials include silica, alumina, titanium oxide, etc. These materials can be used alone or in combination.

The average primary particle diameter of the external additives is preferably from 30 nm to 300 nm, and more preferably from 80 nm to 200 nm. When the average primary particle diameter is too large, the external additive tends to release from the surface of the toner particles. The released external additive often damages image forming members such as photoreceptors. In contrast, when the average primary particle diameter is too small, the external additive tends to be embedded into the toner particles, resulting in increase of the curvature of the surface of the toner particles, thereby causing the omission problem.

It is preferable to use an external additive having a relatively large primary particle diameter and another external additive having a relatively small primary particle diameter. In this case, the large external additive serves as a spacer and prevents the small external additive from being embedded into the toner particles.

The covering ratio is preferably from 15 to 100%. When the covering ratio is too low, the non-electrostatic adhesiveness increases. When the covering ratio is too large (for example, when toner particles are covered with two or more layers of an external additive), the external additive tends to release from the toner particles, thereby often causing a problem in that the image bearing members are damaged by the free external additive.

The particulate inorganic materials for use in the toner of the present invention are preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, etc.

External additives can be added to toner particles by any known method. For example, a mixer such as V-form blenders, HENSCHEL MIXER, and MECHANOFUSION SYSTEM can be preferably used.

The toner of the present invention can be prepared by any known toner manufacturing methods. However, the toner is preferably prepared by the following method.

The toner manufacturing method includes at least the steps:

dispersing a compound having an active hydrogen and a polymer capable of reacting with the compound in an aqueous medium including at least two kinds of particulate resins; and reacting the polymer with the compound to produce a particulate material (i.e., mother toner particles) including a binder resin which is the reaction product of the compound and the polymer; and separating the particulate material from the aqueous medium.

The manufacturing method can include other steps.

The manufacturing method will be explained in detail. In order to prepare the toner, the following operations are performed.

(1) preparation of an aqueous phase liquid;
(2) polymerization of a polymer capable of reacting a compound having an active hydrogen;
(3) synthesis of a compound having an active hydrogen;
(4) preparation of oil phase liquid; and
(5) emulsifying/dispersing the oil phase liquid in the aqueous phase liquid.

The aqueous phase liquid is prepared by dispersing at least two kinds of particulate resins in an aqueous medium. The content of the particulate resins in the aqueous medium is not particularly limited, but the content is generally from 0.5 to 10% by weight.

The oil phase liquid is prepared by dissolving or dispersing at least the compound having an active hydrogen and the polymer reactive with the compound, optionally together with other toner constituents such as colorants, release agents, charge controlling agents and unmodified polyester resins, in an organic solvent. Alternatively, the other toner constituents can be added to the aqueous medium or added when the oil phase liquid is added to the aqueous phase liquid together with the oil phase liquid.

Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ethyl acetate, toluene, xylene, benzene, methylene chloride, 1,2-dichloroethane, chloroform and carbon tetrachloride are preferably used.

The weight ratio of the organic solvent to the toner constituents is from 40/100 to 300/100, preferably from 60/100 to 140/100 and more preferably from 80/100 to 120/100.

In the emulsifying/dispersing process, the oil phase liquid is added to the aqueous phase liquid to prepare an emulsion. In this case, the polymer (such as prepolymers having an isocyanate group) is reacted with the compound having an active hydrogen (such as amines), resulting in crosslinking and/or extension of the polymer, and thereby the binder resin is prepared. The compound having an active hydrogen can be added to the aqueous liquid when the oil phase liquid (which does not include the compound) is added to the aqueous liquid. Alternatively the compound having an active hydrogen can be previously included in the aqueous liquid or the compound can be added to an emulsion of the oil phase liquid and the aqueous phase liquid. In the latter method, the urea-modified polyester resin can be formed at the interface of the oil phase liquid and the aqueous phase liquid (i.e., the surface of the toner particles), and in addition it is possible to form concentration gradient of the polyester resin in the depth direction of the toner particles.

The reaction conditions are not particularly limited, and the conditions are determined depending on the reactivity of the compound and the polymer used. The reaction time is generally from 10 minutes to 40 hours, and preferably from 2 to 24 hours. The reaction temperature is generally from 0 to 150° C., and preferably from 40 to 98° C.

In order to prepare a stable dispersion in which the oil phase liquid including the prepolymer and other toner constituents (e.g., colorants, release agents, charge controlling agents, and unmodified polyester resins) in an aqueous medium, it is preferable to mix the oil phase liquid and the aqueous phase while applying a shearing force thereto.

The dispersing operation is not particularly limited, and known mixers and dispersing machines such as low shearing force type dispersing machines, high shearing force type dispersing machines, friction type dispersing machines, high pressure jet type dispersing machines and ultrasonic dispersing machine can be used.

In this case, it is preferable to prepare an emulsion including particles having an average particle diameter of from 2 to 20 μm. Therefore, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

In the emulsification/dispersing process, the weight ratio of the aqueous medium to the toner constituents is generally from 50/100 to 2000/100, and preferably from 100/100 to 1000/100. When the amount of the aqueous medium is too small, the toner constituents tend not to be well dispersed, and thereby a toner having a desired particle diameter cannot be prepared. In contrast, to use a large amount of aqueous medium is not economical.

A dispersant can be used for the emulsification/dispersion process to prepare toner particles having a sharp particle diameter distribution and to prepare a stable emulsion/dispersion.

Suitable dispersants include surfactants, inorganic dispersants which are hardly soluble in water, polymer protection colloids, etc. These dispersants can be used alone or in combination. Among these dispersants, surfactants are preferably used.

Suitable anionic surfactants include alkylbenzene sulfonic acid salts, α-olefin sulfonic acid salts, and phosphoric acid salts. It is preferable to use fluorine-containing surfactants.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl($C_6$–$C_{11}$)oxy}-1-alkyl($C_3$–$C_4$) sulfonate, sodium 3-{omega-fluoroalkanoyl($C_6$–$C_8$)—N-ethylamino}-1-propanesulfo nate, fluoroalkyl(C11–C20) carboxylic acids and their metal salts, perfluoroalkylcarboxylic acids and their metal salts, perfluoroalkyl($C_4$–$C_{12}$)sulfonate and their metal salts, perfluorooctanesulfonic acid diethanol amides, N-propyl-N-(2-hydroxyethyl)perfluorooctanesulfone amide, perfluoroalkyl($C_6$–$C_{10}$)sulfoneamidepropyltrimethylammonium salts, salts of perfluoroalkyl ($C_6$–$C_{10}$)—N-ethylsulfonylglycin, monoperfluoroalkyl($C_6$–$C_{16}$) ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Suitable cationic surfactants include amine salt based surfactants and quaternary ammonium salt based surfactants.

Specific examples of the amine salt based surfactants include alkyl amine salts, aminoalcohol fatty acid derivatives, polyamine fatty acid derivatives and imidazoline.

Specific examples of the quaternary ammonium salt based surfactants include alkyltrimethyl ammonium salts, dialkyldimethyl ammonium salts, alkyldimethyl benzyl ammonium salts, pyridinium salts, alkyl isoquinolinium salts and benzethonium chloride. It is preferable to use fluorine-containing cationic surfactants.

Specific examples of the cationic surfactants having a fluoroalkyl group include primary, secondary and tertiary aliphatic amino acids having a fluoroalkyl group, perfluoroalkyl(C6–C10) sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORADO FC-135 (from Sumitomo 3M Ltd.) UNIDYNE®DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable nonionic surfactants include fatty acid amide derivatives, and polyhydric alcohol derivatives.

Suitable ampholytic surfactants include alanine, dodecyldi(aminoethyl)glycin, di(octylaminoethyle)glycin, and N-alkyl-N,N-dimethylammonium betaine.

Suitable inorganic dispersants include tricalcium phosphate, calcium carbonate, titanium oxide, colloidal silica, hydroxyapatite, etc.

Suitable polymer protection colloids include homopolymers and copolymers of acids, acrylic monomers having a hydroxyl group, vinyl alcohol and ethers of vinyl alcohol, esters of vinyl alcohol and compounds having a carboxyl group, amides and methylol compounds thereof, chlorides, and monomers having a nitrogen atom; polyoxyethylene compounds; and cellulose compounds.

Specific examples of the acids include acrylic acid, methacrylic acid, α-cyanoacrylic acid, α-cyanomethacrylic acid, itaconic acid, crotonic acid, fumaric acid, maleic acid and maleic anhydride. Specific examples of the acrylic monomers having a hydroxyl group include β-hydroxyethyl acrylate, β-hydroxyethyl methacrylate, β-hydroxypropyl acrylate, β-hydroxypropyl methacrylate, β-hydroxypropyl acrylate, γ-hydroxypropyl methacrylate, γ-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of the vinyl alcohol and its ethers include vinyl methyl ether, vinyl ethyl ether and vinyl propyl ether. Specific examples of the esters of vinyl alcohol with a compound having a carboxyl group include vinyl acetate, vinyl propionate and vinyl butyrate. Specific examples of the acrylic amides include acrylamide, methacrylamide, diacetoneacrylamide and their methylol compounds. Specific examples of the chlorides include acrylic acid chloride and methacrylic acid chloride. Specific examples of the monomers having a nitrogen atom or an alicyclic ring having a nitrogen atom include vinyl pyridine, vinyl pyrrolidone, vinyl imidazole and ethylene imine.

Specific examples of the polyoxyethylene compounds include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the cellulose compounds include methyl cellulose, hydroxyethyl cellulose and hydroxypropyl cellulose.

In the emulsification/dispersion process, a dispersion stabilizer can be used if desired. Specific examples of the dispersion stabilizers include compounds which are soluble in acids and alkalis, such as calcium phosphate.

When such compounds are used as a dispersion stabilizer, the resultant toner particles are preferably mixed with an acid such as hydrochloric acid, followed by washing with water to remove calcium phosphate from the toner particles. In addition, calcium phosphate can be removed using a zymolytic method.

In the emulsification/dispersion process, a known catalyst can optionally be used for crosslinking and/or extending the prepolymer. Specific examples of the catalyst include dibutyltin laurate and dioctyltin laurate.

In order to remove an organic solvent from the thus prepared emulsion, a method in which the emulsion is gradually heated to perfectly evaporate the organic solvent included in the drops of the oil phase liquid can be used. Alternatively, a method in which the emulsion is sprayed in a dry environment to dry the organic solvent in the drops of the oil phase liquid and water in the dispersion, resulting in formation of toner particles, can be used.

The dry environment can be formed by heating gases of air, nitrogen, carbon dioxide, combustion gas, etc., preferably, to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When the organic solvent is removed, toner particles are formed. The thus prepared toner particles are washed and dried. In this case, the dispersant used is preferably removed from the toner particles. When the thus prepared toner particles have a wide particle diameter distribution even after the particles are subjected to a washing treatment and a drying treatment, the toner particles are preferably subjected to a classification treatment using a cyclone, a decanter or a classifier utilizing centrifuge to remove fine particles therefrom. In this case, it is preferable to perform the classification operation in the liquid having the particles in view of efficiency. Toner particles having a particle diameter falling out of the predetermined range can be reused for the emulsification/dispersion process.

The thus prepared toner particles can be mixed with one or more other particulate materials such as colorants, release agents, charge controlling agents, and fluidizers optionally upon application of mechanical impact thereto to fix the particulate materials on the toner particles.

Suitable mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The thus prepared toner can be used as a one component developer. In addition, the toner can be used for a two component developer after mixed with a carrier. When the developer is used for high speed image forming apparatus, two component developers are preferably used.

When the toner mentioned above is used as a one component developer, the developer has the following advantages.

(1) even when the developer is used for a long time while a fresh developer (toner) is replenished, the particle diameter distribution of the developer hardly changes; and
(2) even when the developer is used for a long time, the developer does not cause a problem in that the developer is adhered and fixed to the developing roller and developer layer forming blade used.

Therefore images having good image qualities can be produced for a long period of time.

When the toner is used for the two component developer, the developer has the following advantages.

(1) even when the developer is used for a long time while a fresh toner is replenished, the particle diameter distribution of the toner hardly changes; and
(2) even when the developer is agitated in the developing device, the developer can maintain good developing ability.

Therefore images having good image qualities can be produced.

The carrier for use in the two component developer of the present invention is not particularly limited, and one or more proper carriers are chosen while considering the usage of the developer. However, it is preferable to use a carrier in which a core material is coated with a resin.

Suitable materials for use as the core material include manganese-strontium materials and manganese-magnesium materials, which have a saturation magnetization of from 50 to 90 $Am^2/kg$ (90 emu/g). In view of image density, iron powders (having a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the photoreceptor is relatively weak and high quality images can be produced.

These carrier materials can be used alone or in combination.

The core material of the carrier preferably has a volume average particle diameter ($D_{50}$) of from 10 to 150 μm, and more preferably from 40 to 100 μm. When the volume average particle diameter is too small, a carrier scattering problem tends to occur because the particles have weak magnetization. When the particle diameter is too large, the surface area of the carrier per unit weight decreases and thereby a toner scattering problem tends to occur. In addition, another problem in that uneven solid images are formed tends to occur.

Specific examples of such resins to be coated on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, epoxy resins.

Specific examples of the amino resins include urea-formaldehyde resins, melamine resins, benzoguanamine resins, urea resins, and polyamide resins. Specific examples of the vinyl or vinylidene resins include acrylic-resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins and styrene-acrylic copolymers. Specific examples of the halogenated olefin resins include polyvinyl chloride resins. Specific examples of the polyester resins include polyethyleneterephthalate resins and polybutyleneterephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a resin solution which is prepared by dissolving a resin in a solvent on a core material using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve butyl acetate, etc.

The method for baking is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is too small, a uniform resin layer cannot be formed. When the coated amount is too large, the carrier particles aggregates, and thereby the toner cannot be uniformly charged.

The weight ratio of the toner to the carrier in the two component developer is from 10/90 to 2/98, and preferably from 7/93 to 3/97.

Since the developer includes the toner mentioned above, the developer can stably produce high quality images having good combination of charging property and fixing property.

The developer of the present invention can be used for known electrophotographic dry developing methods such as magnetic one component developing methods, nonmagnetic one component developing methods, two component developing methods, etc.

Then the image forming apparatus and image forming method will be explained in detail referring to drawings.

The image forming apparatus of the present invention typically includes an image bearing member configured to bear an electrostatic latent image and a toner image, a charger configured to charge the image bearing member, a light irradiating device configured to irradiate the charged image bearing member with imagewise light to form an electrostatic latent image on the image bearing member, a developing device configured to develop the latent image with a developer including a toner to form a toner image on the image bearing member, an intermediate transfer medium to which the toner image is primarily transferred from the image bearing member, a transferring device configured to secondarily transfer the toner image onto a receiving material, and a fixing device configured to fix the toner image on the receiving material, and optionally includes a discharger (a quencher) configured to discharge the charges remaining on the image bearing member, a cleaner configured to clean the surface of the image bearing member, a toner recycling device configured to feed the toner particles collected by the cleaner to the developing device, a controller and other devices.

The image forming method of the present invention includes at least an electrostatic latent image forming step, a developing step, an image transferring step, and a fixing step, and optionally includes a discharging step, a cleaning step, a toner recycling step, and a controlling step.

The image forming method is preferably performed using the image forming apparatus mentioned above. The electrostatic latent image forming step is performed with the light irradiating device, the developing step is performed with the developing device, the image transferring step is performed with the transfer device, the fixing step is performed with the fixing device, and the cleaning, toner recycling, and controlling steps are performed with the cleaning device, toner recycling device and controller, respectively.

Then each of the devices and steps will be explained.

(1) latent image forming process and image bearing member.

In the latent image forming process, an electrostatic latent image is formed on an image bearing member.

The image bearing member (hereinafter sometimes referred to as a photoconductive insulator or photoreceptor) for use in the image forming apparatus of the present invention is not particularly limited with respect to the constitution materials, shape, size, etc. Namely, known image bearing members can be used. Among the image forming members, drum-form photoreceptors including a photosensitive material such as inorganic photosensitive materials (e.g., amorphous silicon and selenium) and organic photosensitive materials (e.g., polysilane, phthalopolymethine, organic photoconductors, combinations of charge generation materials and charge transporting materials, etc.) are preferably used. Among these photosensitive materials, amorphous silicon and phthalocyanine based polymethine pigments are preferably used for the photoreceptor because of having long life.

In the latent image forming process, an electrostatic latent image typically is formed by uniformly charging the entire surface of a photoreceptor using a charger, and irradiating the charged photoreceptor with imagewise light using an light irradiator.

Charging is performed by applying a voltage to the photoreceptor using a charger. Known chargers can be used for charging the photoreceptor. For example, contact chargers having a semi-conductive charging element such as rollers, brushes, films and rubber blades; and non-contact chargers such as corotrons and scorotrons can be used.

Image irradiation is performed by irradiating the charged photoreceptor with imagewise light using a light irradiating device. Known light irradiators can be used and a proper light irradiator is chosen and used for the image forming apparatus of the present invention. Specific examples thereof include optical systems for use in reading images in copiers; optical systems using rod lens arrays; optical systems using laser; and optical systems using a liquid crystal shutter.

It is possible to irradiate the photoreceptor from the backside of the photoreceptor.

In the developing process, the electrostatic latent image formed above is developed with the toner (or the developer including the toner) mentioned above to visualize the electrostatic latent image using a developing device.

Known developing devices can be used for the image forming apparatus of the present invention as long as the toner (or the developer) can be used therefor. For example, developing devices containing the toner or developer therein and having a developing element which supplies the toner to the photoreceptor while being in contact or non-contact with the photoreceptor can be used.

The developing device is a dry developing device which includes one or more developing sections to develop one or more color images. The developing device includes an agitator configured to agitate the toner or developer to charge the toner, and a developer bearing member bearing the toner or developer to supply the toner to the photoreceptor.

In the developing device, the toner and a carrier are agitated so that the toner is charged. The toner and carrier are then fed to the developer bearing member and form a magnetic brush on the surface of the developer bearing member. The toner in the magnetic brush is electrostatically attracted by the electrostatic latent image, resulting in transferring of the toner to the latent image. Thus, the latent image is developed with the toner, resulting in formation of a toner image.

The developer contained in the developing device may be a one-component developer which includes the toner mentioned above and does not include a carrier, or a two-component developer which includes the toner and a carrier (i.e., the two-component developer).

In the transferring process, the toner image formed above is transferred to a receiving material via an intermediate transfer medium. When multiple color images and full color images are formed using two or more color toners, it is preferable that plural color toner images are transferred to an intermediate transfer medium one by one (first transfer process), and the plural toner images on the intermediate transfer medium is transferred to a receiving material at the same time (second transfer process).

It is preferable that toner images are transferred while applying a voltage to the image bearing member and/or the transferring element. The transferring device includes a first transferring member which transfers the toner image on the photoreceptor to the intermediate transfer medium and a second transferring member which transfers the toner image on the intermediate transfer medium to a receiving material.

The intermediate transfer medium is mentioned above.

Suitable transferrers for use in the (first and second) transferring members to easily transfer the toner images to a receiving material include corona discharging transferrers, transfer belts, transfer rollers, pressure transfer rollers, adhesive transferrers.

The receiving material is not particularly limited and known receiving materials can be used.

In the fixing process, the toner image transferred to a receiving material is fixed using a fixing device. When plural toner images are transferred, the fixing operation can be made to each of the toner images transferred on the receiving material one by one, or all the toner images transferred on the receiving material at the same time.

The fixing device is not particularly limited, and a proper fixing device is chosen and used for the image forming apparatus of the present invention. Suitable fixing devices include heat fixing devices which heat toner images while applying a pressure thereto. Specific examples thereof include combinations of a heat roller and a pressure roller, and combinations of a heat roller, a pressure roller and an endless belt.

When a heat fixing device is used, the fixing temperature is preferably from 80 to 200° C.

It is possible to use a fixing device which fixes toner images using light.

In the discharging (quenching) process, charges remaining on the photoreceptor even after the toner image thereon is transferred from the photoreceptor to a receiving material are discharged by applying a bias voltage to the photoreceptor or irradiating the photoreceptor with light, using a discharging device.

Known discharging devices can be used. Specific examples thereof include discharging lamps.

In the cleaning process, toner particles remaining on the surface of the photoreceptor even after the toner image thereon is transferred on a receiving material are removed therefrom using a cleaning device.

Known cleaners can be used as the cleaning device. Specific examples thereof include magnetic brush cleaners, electrostatic brush cleaners, magnetic roller cleaners, blade cleaners, brush cleaners, and web cleaners.

In the toner recycling process, the toner collected by the cleaners are returned to the developing device using a recycling device to be reused for developing electrostatic latent images.

Known powder feeding devices can be used as the recycling device.

In the controlling step, controlling of the above-mentioned processes is performed by a controller such as sequencers, and computers.

Then the image forming apparatus will be explained in detail. Any image forming apparatus having such a constitution as mentioned above can be used as the image forming apparatus of the present invention. For example, image forming apparatus illustrated in FIGS. 1 and 2 are preferably used.

Figure 2:
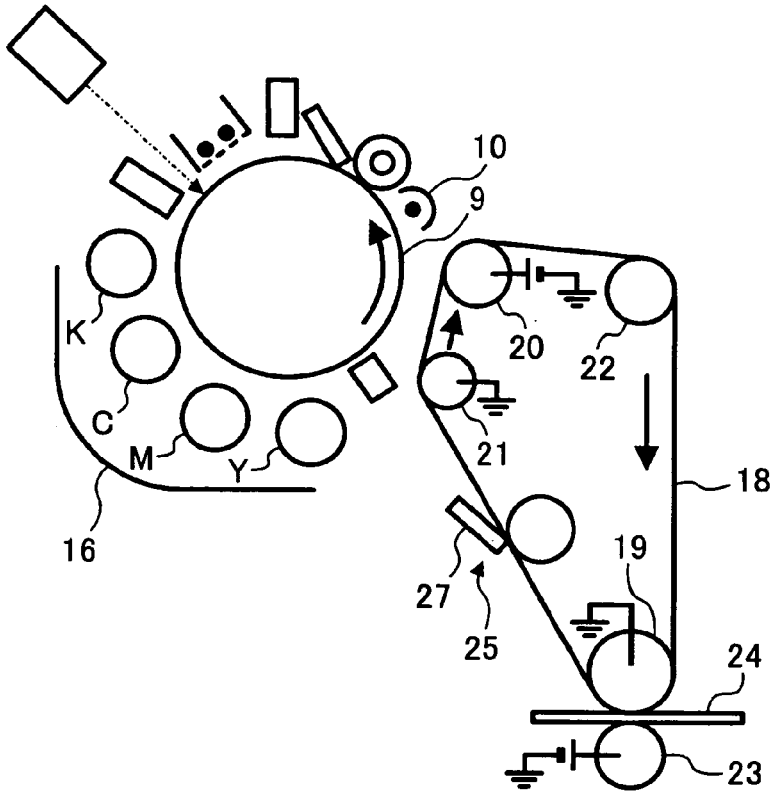
FIG. 2 is a schematic view illustrating the main portion of another example of the image forming apparatus of the present invention.

FIG. 1 illustrates an embodiment of the image forming apparatus of the present invention.

Referring to FIG. 1, the image forming apparatus includes a photoreceptor belt 1 serving as an image bearing member; a developing device 8 having a black developing unit K, a cyan developing unit C, a magenta developing unit M and a yellow developing unit Y, which are arranged along the photoreceptor belt 1; an intermediate transfer drum 3 which is contacted with the photoreceptor belt 1 while forming a predetermined nip F at which the primary transfer operation is performed; a secondary transfer roller 4 which is contacted with the intermediate transfer drum 3 at a position S which is located on a downstream side from the nip F relative to the rotation direction of the intermediate transfer drum 3 and in which the secondary transfer operation is performed; a paper discharging device 6 which is located on a downstream side from the secondary transfer roller 4 relative to the feeding direction of a receiving material 5; and a cleaning device 7 which faces the intermediate transfer drum 3 and which is configured to clean the surface of the intermediate transfer drum 3.

The intermediate transfer drum 3 is the intermediate transfer medium of the present invention and includes a cylindrical substrate and an outermost layer formed on the cylindrical substrate.

In the image forming apparatus illustrated in FIG. 1, a color toner image T, which is formed on the photoreceptor belt 1 by one of the developing units Y, M, C and K, is transferred to the intermediate transfer drum 3 at the primary transfer portion (i.e., the nip) F while a predetermined bias voltage is applied thereto, wherein the drum 3 is rotated while synchronizing with the photoreceptor belt 1. When a full color image is produced, other three toner images are similarly primarily transferred to the respective positions of the intermediate transfer drum 3. Thus, four color toner images are overlaid on the intermediate transfer drum 3, resulting in formation of a full color toner image thereon.

The secondary transfer roller 4 is ordinarily separated from the intermediate transfer drum 3. However, when the following secondary transfer operation is performed, the roller 4 is moved so as to contact with the drum 3.

The receiving sheet 5 is timely fed while synchronizing with the intermediate transfer drum 3, and passes through the nip S. In this case, a bias voltage having a polarity opposite to that of the charge of the toners is applied to the secondary transfer roller 4, and thereby the toner image on the intermediate transfer drum 3 is transferred to the receiving sheet 5 at the nip S. The receiving sheet 5 bearing the toner image thereon is then applied with a predetermined charge by the paper discharging device 6 to discharge the charge remaining therein. Then the receiving sheet 5 bearing the toner image thereon is fed to a fixing device (not shown) so that the toner image is fixed on the receiving sheet 5.

On the other hand, toner particles remaining on the intermediate transfer drum 3 are removed with the cleaning device 7 (such as brush cleaners and roller cleaners). Then the intermediate transfer drum 3 is discharged with a discharging device (not shown) so as to be initialized.

The image forming apparatus illustrated in FIG. 2 includes a photoreceptor drum 9 serving as an image bearing member; a developing device 16 including black (K), cyan (C), magenta (M) and yellow (Y) developing units, which are arranged around the photoreceptor drum 9; an intermediate transfer belt 18 which, when a toner image is transferred, is contacted with the photoreceptor drum 9 while forming a predetermined nip at which the primary transfer operation is performed; a secondary transfer roller 23 which is contacted with the intermediate transfer belt 18 at a position which is located on a downstream side from the nip relative to the rotation direction of the intermediate transfer belt 18 and in which the secondary transfer operation is performed; plural rollers 19, 20, 21 and 22 which support the intermediate transfer belt 18 while stretching the belt; and a cleaning device 25 which faces the intermediate transfer belt 18 and which is configured to clean the surface of the intermediate belt 18.

The intermediate transfer belt 18 is the intermediate transfer medium of the present invention. The belt 18 is an endless belt and can have a single-layered constitution such that only an outermost layer constitutes the endless belt or a multi-layered constitution such that an outermost layer is formed on a substrate, or the like.

In the image forming apparatus illustrated in FIG. 2, a color toner image, which is formed on the photoreceptor drum 9 by one of the developing units Y, M, C and K, is transferred to the intermediate transfer belt 18 at the primary transfer portion (i.e., the nip between the photoreceptor drum 9 and the intermediate transfer belt 18) while a predetermined bias voltage is applied thereto, wherein the belt 18 is rotated while synchronizing with the photoreceptor drum 9. When a full color image is produced, other three toner images are similarly primarily transferred to the respective positions of the intermediate transfer belt 18. Thus, four color toner images are overlaid on the intermediate transfer belt 18, resulting in formation of a full color toner image thereon.

The secondary transfer roller 23 is ordinarily separated from the intermediate transfer belt 18. However, when the following secondary transfer operation is performed, the roller 23 is moved so as to contact with the belt 18.

On the other hand, a receiving sheet 24 is timely fed while synchronizing with the intermediate transfer belt 18, and passes through the nip between the secondary transfer roller 23 and the intermediate transfer belt 18. In this case, a bias voltage having a polarity opposite to that of the charge of the toners is applied to the secondary transfer roller 23, and thereby the toner image on the intermediate transfer belt 18 is transferred to the receiving sheet 24 at the nip. Then the receiving sheet 24 bearing the toner image thereon is fed to a fixing device (not shown) so that the toner image is fixed on the receiving sheet 24.

On the other hand, toner particles remaining on the intermediate transfer belt 18 are removed with a cleaning blade 27 of the cleaning device 25.

Numeral 10 denotes a discharger configured to discharge the charges remaining on the photoreceptor drum 9.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Intermediate Transfer Medium Forming Varnish

A rigid polyimide forming varnish, U-VARNISH S from Ube Industries, Ltd., in which a rigid polyamide acid having the below mentioned formula (2) is dissolved in an amide solvent, N-methylpyrrolidone, and a flexible polyimide forming varnish, U-VARNISH A from Ube Industries, Ltd., in which a flexible polyamide acid having the below mentioned formula (3) is dissolved in an amide solvent, N-methylpyrrolidone, were mixed in a mixing ratio of 5:5. Thus, a mixture varnish was prepared.

(2)

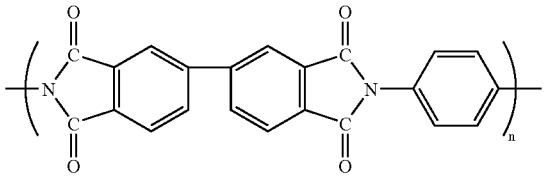

(3)

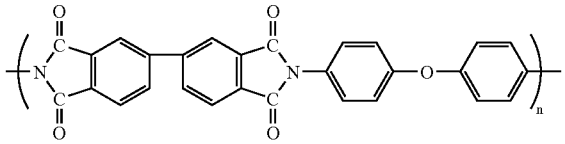

The thus prepared mixture varnish (V) was mixed with a masterbatch liquid (M), in which a carbon black is dispersed, in a weight ratio (V/M) of 8/2.

Preparation of Intermediate Transfer Medium

A seamless belt-form intermediate transfer medium was prepared by the following method.

Figure 6A:
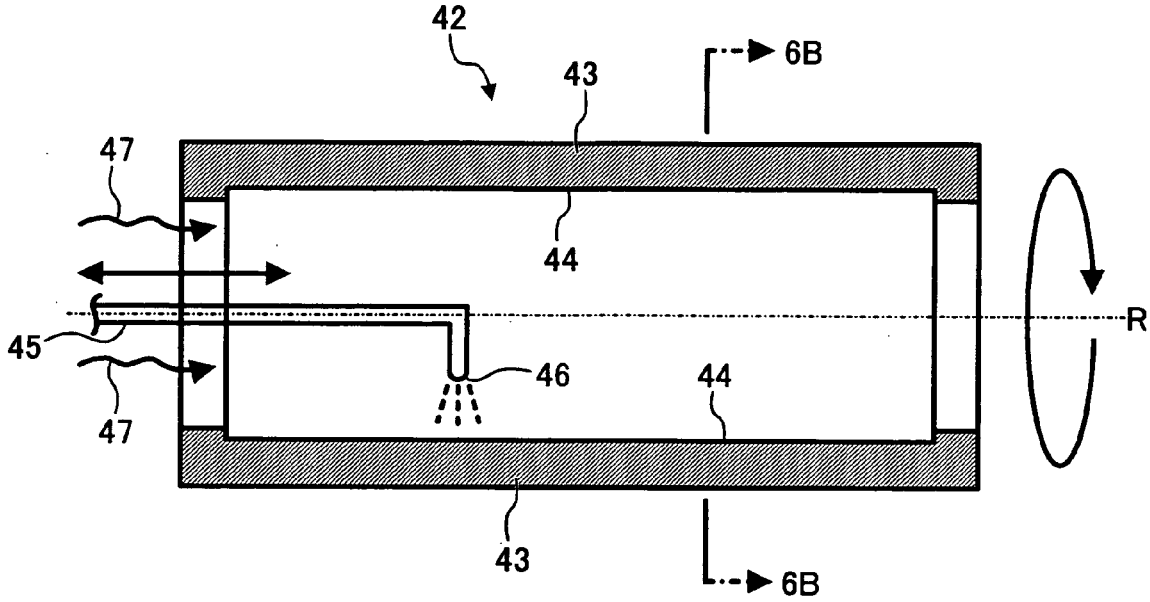
FIGS. 6A and 6B are schematic views illustrating a centrifugal molding device for use in preparing the intermediate transfer medium of the present invention.
Figure 6B:
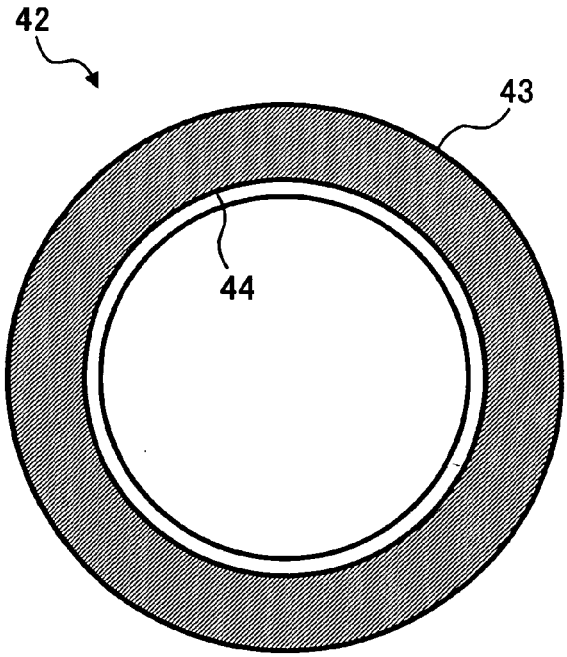

FIG. 6A illustrates a centrifugal molding machine used for preparing the seamless belt-form intermediate transfer medium. FIG. 6B illustrates a cross section of the molding machine cut at a line illustrated in FIG. 6A. In FIG. 6A, a centrifugal molding machine 42 has a cylindrical molding tool 43, which is rotated around a horizontal axis R at a revolution of 500 rpm. A release liquid was coated on the entire surface of a cavity 44 of the molding tool 43 so that a thin layer of the release liquid having a thickness of about 50 μm is formed on the entire surface.

After the rotation speed was decreased to 100 rpm, the above-prepared mixture varnish was sprayed from a nozzle 46 of a spray 45, which is inserted into the molding tool 43. Thus, the mixture varnish was coated on the entire surface of the cavity 44.

Then the rotation speed of the molding tool 43 was increased to 500 rpm to uniform the thickness of the coated varnish. Thus, a belt forming layer was formed on the cavity 44.

Further, dry air 47 of about 100° C. was introduced into the molding tool 43 to dry the belt forming layer. The dried belt forming layer was pulled out of the molding tool 43. The belt was then set in another molding tool and heated at 120° C. for 20 minutes to remove the solvent remaining in the belt and to form an endless polyimide belt.

The properties of the thus prepared endless intermediate transfer medium were evaluated as follows.

Thickness

The thickness of the endless belt was measured with a micrometer made by Mitutoyo Corporation. The results are shown in Table 1.

Time Constant and Capacitance

An intermediate transfer medium was charged with a scrotron charger using an electrostatic paper analyzer, EPA- 8200 manufactured by Kawaguchi Electric Works, wherein the charging conditions are as follows:

Charging mode: dynamic mode;

Discharge current: 18 μA; and

Charging time: 10 seconds;

(2) after stopping the charging, change of the surface potential of the intermediate transfer medium was recorded to obtain a potential decaying curve; and (3) the time constant τ was determined from the potential decaying curve using the following equation (1):

$$V=A\exp(-t/\tau) \quad (1)$$

wherein A represents a constant.

At the same time, the total quantity (Q) of the charges during the charging and the surface potential (−V) of the intermediate transfer medium were measured using an ampere meter and an electrometer which are contained in the electrostatic paper analyzer. The capacitance (C) of the intermediate transfer medium was determined from the slope of beginning of the surface potential curve using an equation (2) C=Q/V.

The specific dielectric constant ∈r was determined by the following equation (3):

$$C=(\in r\cdot\in 0\cdot S)/d \quad (3)$$

wherein ∈0 represents the vacuum dielectric constant (i.e., $8.854\times10^{-12}$ A·s/V·m), S represents the area of the charged portion of the intermediate transfer medium, and d represents the thickness of the outermost layer (or the intermediate transfer medium).

The results are shown in Table 1.

Particle Diameter

A toner and a silicone-coated carrier for use in a color copier, IMAGIO COLOR 5100 from Ricoh Company Limited, were used for the developer. The carrier has a volume average particle diameter 80 μm. The toner and carrier were mixed in a weight ratio (T/C) of 6/94 and the mixture was well mixed using TURBULA MIXER.

The volume average particle diameter of the toner was measured with a particle diameter measuring instrument, MULTISIZER II from Beckmann Coulter.

Circularity

The average circularity of the toner was determined by a flow particle image analyzer FPIA-1000 from Sysmex Corp. The circularity of a toner is determined by the following method:

(1) few drops of a nonionic surfactant (preferably CONTAMINON N from Wako Pure chemical Industries, Ltd.) are added to 10 ml of water, from which dust had been removed using a filer to an extent such that particles having a circle-equivalent diameter of from 0.60 μm to 159.21 μm are present in an amount less than 20 pieces per a unit volume of $10^{-3}$ $cm^3$;

(2) five milligrams of the toner are added to the water, and the mixture is subjected to an ultrasonic treatment for 6 minutes in total (i.e., 1+5 minutes) using an ultrasonic dispersing machine UH-50 from STM Co., under the dispersion conditions of 20 kHz in frequency and 50 W/10 $cm^3$ in power, to prepare a dispersion in which toner particles are dispersed at a concentration of from 4,000 to 8,000 pieces per $10^{-3}$ $cm^3$;

(3) the dispersion is flown through a flat and transparent flow cell having a thickness of 200 μm while the flown particles are photographed using a flash lamp and a CCD camera to determine the average circularity of the toner.

The flash lamp emits light beams at regular intervals of 1/30 second, and the circle-equivalent particle diameter of not less than 1200 toner particles can be determined in a minute. Thus, circle-equivalent particle diameter distribution curve of the toner representing percentage of toner particles in each of 226 channels in a range of from 0.06 μm to 400 μm can be obtained. In reality, the measurements were performed in a range of from 0.60 μm to 159.21 μm.

The toner of Example 1 has an average circularity of 0.95.

Covering Ratio

The covering ratio is determined by the following method.

At first, the toner is adhered to a sample plate of a scanning electron microscope (SEM), S-4500 from Hibachi Ltd. The plate bearing the toner is coated with gold, and the plate is set in the SEM. The surface of the toner is observed with a power magnification of 30,000 and the image is analyzed using a personal computer and an image processing software (IMAGE-PRO PLUS from Media Cybernetics). The covering ratio is defined as the ratio of the area of the surface of toner particles covered with an external additive to the total surface area of the toner particles. The covering ratio is measured with respect to 50 to 100 toner particles and the data are averaged. The toner has a covering ratio of 12.20%.

Vertical Direction Adhesion

The vertical direction adhesion between unfixed toner particles and a photoreceptor is measured by a centrifugal separation method. Specifically, the method is as follows:

(1) an organic photosensitive material is coated on an aluminum layer deposited on a polyethylene terephthalate film to prepare a photoreceptor film;

(2) the photoreceptor film is cut to prepare a circle photoreceptor film with a diameter of 7.8 mm;

(3) the circle photoreceptor film is adhered to a sample plate of the centrifugal separation machine using an adhesive;

(4) the toner is allowed to fall on the circle photoreceptor so as to adhere thereto; and (5) the circle photoreceptor bearing the toner is subjected to a centrifugal separation treatment to measure the non-electrostatic adhesion between the toner and the photoreceptor (i.e., the vertical adhesion Fv).

This centrifugal separation method is described in detail in IS&T NIP7th p200 (1991), incorporated herein by reference.

Figure 3:
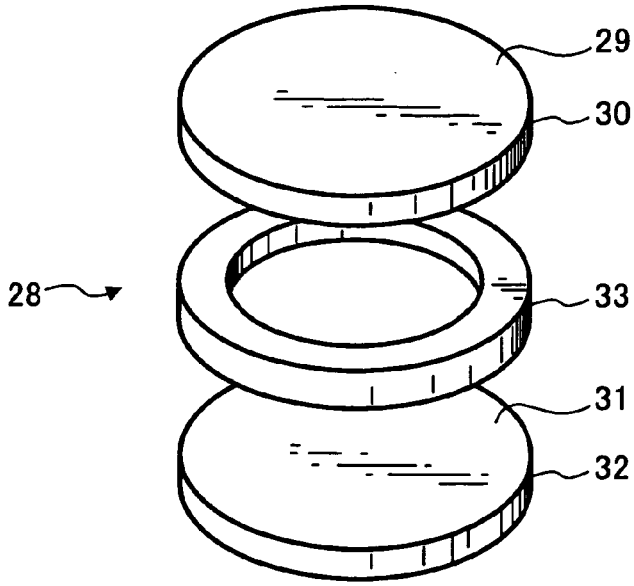
FIG. 3 is a schematic view illustrating a cell for use in measuring the adhesion of a toner.
Figure 4:
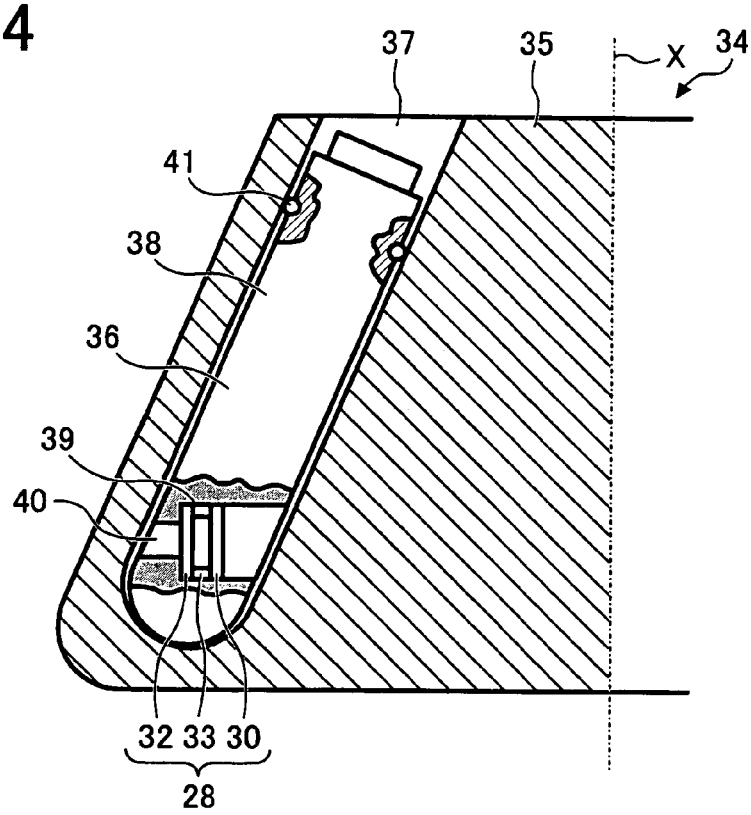
FIGS. 4 and 5 are partial cross sections of a centrifugal separation machine for use in measuring the adhesion of a toner.

The centrifugal separation method uses the cell and centrifugal separation machine, illustrated in FIGS. 3 and 4, respectively.

In FIG. 3, a cell 28 includes a sample plate 30 having a surface 29 on which the circle photoreceptor is to be set; a receiving plate 32 having a surface 31 which receives toner particles released from the surface 29 when receiving a centrifugal force; and a spacer 33 which is set between the sample plate 30 and the receiving plate 32.

FIG. 4 illustrates a partial cross section of a centrifugal separation machine 34. The centrifugal separation machine 34 has a rotor 35 configured to rotate the cell 28 and a holding member 36 configured to hold the cell 28. The rotor 35 has a hole 37 which slants toward a rotation axis X of the rotor 34 and in which the cell 28 is to be set.

The holding member 36 has a cylinder 38, a cell holder 39 which is formed in the cylinder 38 and which is configured to support the cell 28, a hole 40 through which the cell is pushed out of the cell holder 39, and a fixing member 41 configured to fix the cylinder 38 to the hole 37. The cell holder 39 has a structure such that when the cell is set therein, the center axis of the cell 28 becomes perpendicular to the rotation axis X of the rotor 35.

Then the method for measuring the adhesion between the toner and the photoreceptor using the centrifugal separation machine 34 will be explained.

At first, the circle photoreceptor prepared above is adhered to the surface 29 of the sample plate 30 using an adhesive. In this regard, the photosensitive layer may be directly formed on the surface 29. Then the toner is allowed to fall on the photoreceptor on the sample plate 30. The sample plate 30 is combined with the spacer 33 and the receiving plate 32 to construct the cell 28. Then the cell 28 is set in the cell holder 39 of the holding member 36 in a manner such that the sample plate 30 is nearer to the rotation axis X than the receiving plate 32.

The holding member 36 is set in the hole 37, and the rotor 35 is rotated at a predetermined revolution. The toner particles on the surface 29 receive a centrifugal force which changes depending on the revolution. When the centrifugal force is larger than the adhesion of the toner particles to the photoreceptor, the toner particles are separated from the photoreceptor and adhere to the surface 31.

The centrifugal force Fc that the toner particles receive is determined by the following equation (10):

$$Fc=m\times r\times(2\pi f/60)^2 \quad (10)$$

wherein m represents the weight of the toner, f represents the revolution of the rotor in units of rpm, and r represents the distance between the surface 29 and the rotation axis X.

The weight of the toner can be determined by the following equation (20):

$$m=(\pi/6)\times\rho\times d^3 \quad (20)$$

wherein ρ represents the true specific gravity of the toner, and d represents the circle-equivalent particle diameter of the toner.

Therefore, the centrifugal force is represented by the following equation (30):

$$Fc=(\pi^3/5400)\times\rho\times d^3\times r\times f^2 \quad (30)$$

After the centrifugal separation operation is completed, the holding member 36 is pulled out of the hole 37, and the cell 28 is pulled out of the cell holder 39. Then the receiving plate 32 is replaced with another. The cell 26 is set again in the cell holder 39, and the holding member 36 is set in the hole 37 of the rotor 35. Then the rotor 35 is rotated at a revolution higher than in the last operation such that toner particles having a higher adhesion are released from the surface 29 and adhere to the surface 31.

This centrifugal separation operation is performed several times while the revolution is changed from low to high revolution. After each separation operation, the particle diameter of the toner particles adhered to the surface 31 is measured. The particle diameter is measured by observing the toner particles on the surface 31 with an optical microscope equipped with a CCD camera, and inputting the image of the toner particles stored in the camera to an image processor to determine the particle diameter of the toner particles.

The adhesion of toner particles released from the surface 29 at a revolution is smaller than the centrifugal force (1) that the toner particles receive at the centrifugal operation, and is larger than the centrifugal force (2) that the toner particles receive at the last centrifugal operation. Therefore, the centrifugal forces (1) and (2) are determined by equation (30) and averaged to determine the adhesion of the toner particles. In addition, the average (F) of the adhesion of the toner is determined by the following equation:

$$F=10A$$

wherein A represents the arithmetic average of common logarithm of adhesions of toner particles determined in each separation operation.

Horizontal Direction Adhesion

The horizontal direction adhesion of the toner located on the photoreceptor is also determined by a method similar to the vertical direction adhesion measuring method mentioned above.

Figure 5:
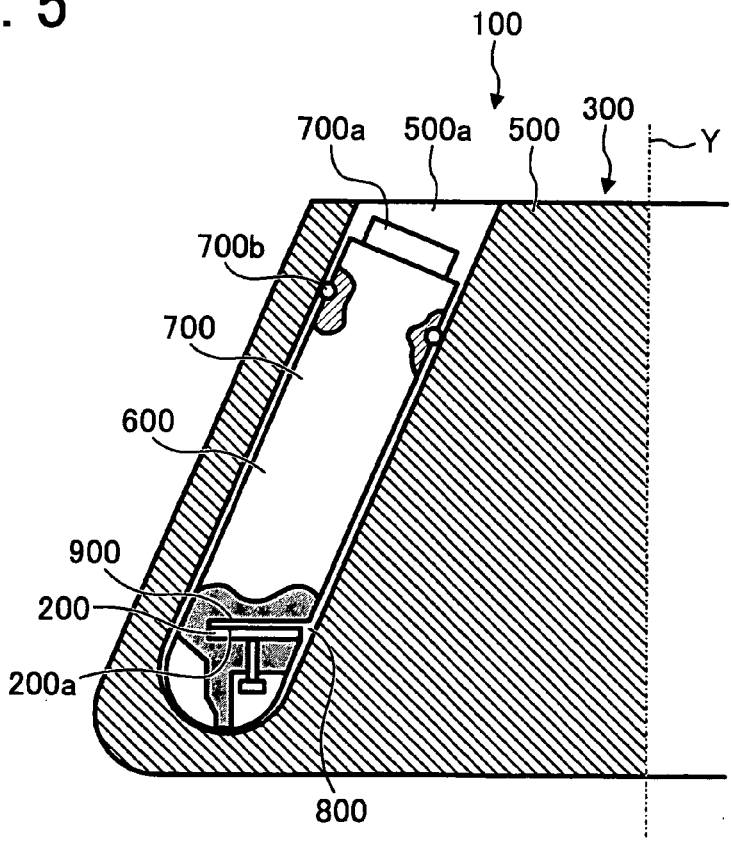

FIG. 5 is a partial cross section of the centrifugal separation machine used for measuring the horizontal direction adhesion.

In FIG. 5, a horizontal direction adhesion measuring instrument 100 includes a centrifugal separation machine 300 and a sample plate 200 having a surface 200*a* having a square form. The centrifugal separation machine 300 has a rotor 500 and a holding member 600. The rotor 500 rotates around a rotation axis Y. The sample plate 200 is set so that the surface 200*a* faces upward, i.e., is perpendicular to the rotation axis Y.

The rotor 500 has a hole 500*a* having a shape corresponding to that of the holding member 600. The rotor 500 is an angle rotor in which the upper surface having the opening of the hole 500*a* has an area smaller than that of the bottom surface thereof, namely the hole 500*a* slants toward the rotation axis Y.

The holding member 600 has a cylinder 700, and a sample holder 800 configured to hold the sample plate 200. The cylinder 700 has an adjusting member 700*a* located on a top of the cylinder 700, and a fixing member 700*b* configured to fix the cylinder 700 by engaging with the inner surface of the hole 500*a*.

The sample holder 800 has a fixing member configured to fixedly support the sample plate 200 relative to the holding member 200, and a guide 900. The guide 900 is formed on an edge portion of the sample holder 800 to prevent the surface 200*a* from being contacted with the inner surface of the sample holder 800. A space is formed between the guide 900 and the sample plate 200.

The fixing member provided on the sample holder 800 fixes the sample plate 200, which is inserted to the sample holder 800 such that the surface 200*a* faces upward, to the cylinder 600 using a screw. The sample plate 200 has a shape so as to be able to be set to the sample holder 800 from a predetermined direction. The sample plate 200 and the holding member 600 are made of materials having light weight so that the rotor 500 can rotate at a maximum revolution. The adjusting member 700*a* has a projection which is rotated with a proper jig or a recessed portion which can engage with a head of a driver. By rotating the projection or the recessed portion, the direction of the holding member 600 can be adjusted. The fixing member 700*b* is made of an elastic material such as rubbers.

The method for measuring the horizontal direction adhesion includes a plate setting step and an adhesion measuring step.

In the plate setting step, the sample plate 200 is set in the sample holder 800 so that the surface 200*a* faces upward. The sample plate 200 is fixed to the holding member 600 with a screw. The holding member 600 is set in the hole 500*a* and the direction of the holding member is adjusted by rotating the holding member using the adjusting member 700*a*. Thus, the sample plate 200 is set so as to perpendicular to the rotation axis Y of the rotor 500. Namely, when the rotor is rotated, the toner on the sample plate 200 receives a centrifugal force in the direction parallel to the surface 200*a*.

In the adhesion measuring step, the rotor 500 is rotated around the rotation axis Y, and thereby the toner particles on the surface 200*a* are moved by the centrifugal force. As mentioned above in the vertical direction adhesion measuring method, the horizontal direction adhesion of the toner particles can also be determined by equation (30). In this case, the distance r means the distance between the center of the area on which the toner is adhered and the rotation axis Y.

The horizontal direction adhesion can also be determined by a method disclosed in JP-A 11-64212.

The instrument for use in measuring the vertical direction and horizontal direction adhesion and the measuring conditions are as follows:

Instrument: CP100α from Hitachi Koki Co., Ltd.

Rotor: angle rotor P100AT from Hitachi Koki Co., Ltd.

Image processing apparatus: HYPER 700 from Interquest

Sample plate and receiving plate: an aluminum plate having a diameter of 8 mm and a thickness of 1.5 mm Spacer: an aluminum ring having an outside diameter of 8 mm, an inside diameter of 5.2 mm and a thickness of 1 mm Holding member: an aluminum cylinder having a diameter of 13 mm and a length of 59 mm Distance r: 64.5 mm Revolution f of the rotor: 100, 1600, 2200, 2700, 3200, 5000, 7100, 8700, 10000, 15800, 22400, 31600, 50000, 70700, 86600 and 100000 rpm Image Quality The intermediate transfer medium was set in a color copier, IMAGIO COLOR 5100 from Ricoh Co., Ltd., which uses an intermediate transfer method and a two component developer and which is modified such that the intermediate transfer medium is stopped at a desired time during an image forming operation. Then an electrostatic latent image, which includes plural solid images and line images and formed on the photoreceptor drum, was developed with the developer to prepare a toner image. In the middle of the primary transfer operation in which the toner image is transferred to the intermediate transfer medium, the transfer operation was stopped. The photoreceptor drum and the intermediate transfer unit were pulled out of the copier. The pile height of the solid image on the photoreceptor was measured. In addition, the line images on the intermediate transfer medium were evaluated. In this regard, the toner image forming conditions were adjusted such that the toner image has two or more layers and a weight of about 0.7 mg/cm$^2$. The image forming members (i.e., the photoreceptor drum and the intermediate transfer medium) were rotated at a speed of 250 mm/s.

Evaluation of Toner Scattering

The intermediate transfer medium of Example 1 was set in an image forming apparatus having the structure illustrated in FIG. 2 and a test image having a one dot line image was formed. The one dot line image was evaluated with a COLOR LASER 3D PROFILE MICROSCOPE VK8500 from Keyence Corp. Namely, the toner images was digitized. The image was then binarized using an image processing software (PHOTOSHOP from Adobe). The binarized image was analyzed using an image analyzing software (IMAGE PRO from Media Cybernetics) to determine the area of toner particles isolated from the one dot line image. The toner scattering property was graded into the following 4 ranks.

Rank 4: The area of isolated toner particles is less than 5% (good).

Rank 3: The area of isolated toner particles is less than 10% (acceptable).

Rank 2: The area of isolated toner particles is not less than 10% and less than 20% (not acceptable).

Rank 1: The area of isolated toner particles is greater than 20% (bad).

Example 2

The toner used in Example 1 was replaced with a toner prepared by the following method.

Preparation of Modified Polyester Resin

The following components were contained in a reaction vessel equipped with a condenser, a stirrer and a nitrogen introducing tube and reacted for 8 hours at 230° C. under normal pressure.

| | |
|---|---|
| Ethylene oxide adduct (2 mole) of bisphenol A | 724 parts |
| Isophthalic acid | 276 parts |
| Dibutyl tin oxide | 2 parts |

Then the reaction was further continued for 5 hours under a reduced pressure of from 10 to 15 mmHg, followed by cooling to 160° C. Then the reaction product was mixed with 32 parts of phthalic acid anhydride and the mixture was reacted for 2 hours.

After being cooled to 80° C., the reaction product was further reacted with 188 parts of isophoron diisocyanate in ethyl acetate for 2 hours. Thus, a polyester prepolymer having an isocyanate group was prepared.

Then the following components were reacted for 2 hours at 50° C.

| | |
|---|---|
| Polyester prepolymer prepared above | 267 parts |
| Isophoronediamine | 14 parts |

Thus, a urea-modified polyester resin having a weight average molecular weight of 64000 was prepared.

Preparation of Unmodified Polyester Resin

The following components were contained in a reaction container equipped with a condenser, a stirrer and a nitrogen introducing tube to perform a polycondensation reaction for 8 hours at 230° C. under normal pressure.

| | |
|---|---|
| Ethylene oxide adduct (2 mole) of bisphenol A | 724 parts |
| Terephthalic acid | 276 parts |

Then the reaction was further continued for 5 hours under a reduced pressure of from 10 to 15 mmHg. Thus, an unmodified polyester resin having a peak molecular weight of 5000 was prepared.

Then 200 parts of the urea-modified polyester resin and 800 parts of the unmodified polyester resin were dissolved in 2000 parts of a mixture solvent in which ethyl acetate and methyl ethyl ketone is mixed in a ratio of 1/1 to prepare a binder solution. A part of the binder solution was dried to obtain a binder resin. The binder resin had a glass transition temperature of 62° C.

Preparation of Toner

The following components were contained in a beaker.

| | |
|---|---|
| Toner binder solution prepared above | 240 parts |
| Pentaerythritol tetrabehenate (melting point of 81° C. and melt viscosity of 25 cps) | 20 parts |
| Copper phthalocyanine blue pigment | 4 parts |

The mixture was agitated at 60° C. using TK HOMOMIXER in which a rotor was rotated at a revolution of 12000 rpm. Thus, a dispersion was prepared.

On the other hand, the following components were contained in a beaker and mixed to prepare a solution.

| | |
|---|---|
| Ion-exchange water | 706 parts |
| 10% aqueous dispersion of hydroxyapatite (SUPERTITE 10 from Nippon Chemical Industrial Co., Ltd.) | 294 parts |
| Sodium dodecylbenzenesulfonate | 0.2 parts |

After being heated to 60° C., the mixture was agitated using TK HOMOMIXER in which a rotor was rotated at a revolution of 12000 rpm. Thus, an aqueous phase liquid was prepared.

The dispersion prepared above was added to the aqueous phase liquid, and the mixture was agitated for 10 minutes using the TK HOMOMIXER. The mixture was then heated to 98° C. to remove the solvent (i.e., ethyl acetate and methyl ethyl ketone). The thus prepared dispersion was then subjected to filtration, washing, drying and classification treatments. As a result, colored particles having a volume average particle diameter of 4.8 μm were prepared.

Then the following components were mixed in a Q-form mixer manufactured by Mitsui Mining Co., Ltd.

| | |
|---|---|
| Colored particles prepared above | 100 parts |
| Charge controlling agent (BONTRON E-84 from Orient Chemical Co., Ltd.) | 0.2 parts |

The mixing conditions are as follows:

Volume of the mixture: not greater than ½ of the mixer

Turbine blade: turbine blade for low-volume mixing

Peripheral speed of turbine blade: 50 m/s

Mixing operation: operation of mixing for 2 minutes followed by pause of 1 minute was performed 5 times Thus, a particulate polymer material A was prepared.

The following components were mixed with HENSCHEL MIXER.

| | |
|---|---|
| Particulate polymer material A | 100 parts |
| Small particle diameter silica (Silica A) (Silica B, primary particle diameter of 14 nm) | 0.8 parts |
| Hydrophobized large particle diameter silica (primary particle diameter of 120 nm) | 0.6 parts |

Thus, a toner A was prepared.

The procedure for production and evaluation of images in Example 1 was repeated except that the toner was replaced with the toner A prepared above. As a result, the toner has an average circularity of 0.99 and a covering ratio of 15.80%. Other properties are shown in Table 1.

Example 3

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 7/3.

Then the procedure for production and evaluation of images in Example 2 was repeated. The results are shown in Table 1.

Example 4

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 6/4.

Then the procedure for production and evaluation of images in Example 2 was repeated. The results are shown in Table 1.

Example 5

The procedure for preparation of the intermediate transfer medium in Example 1 was repeated except that the mixing ratio of the mixture varnish to the masterbatch liquid including a carbon black was changed from 8/2 to 6/4.

Then the procedure for production and evaluation of images in Example 2 was repeated. The results are shown in Table 1.

Example 6

The procedure for preparation of the intermediate transfer medium in Example 1 was repeated except that when the masterbatch liquid including a carbon black was prepared, a nonionic surfactant (SURFINOL 465 from Nisshin Chemical Co., Ltd.) was added thereto in an amount of 2% by weight of the carbon black.

Then the procedure for production and evaluation of images in Example 2 was repeated. The results are shown in Table 1.

Example 7

The procedure for preparation of the intermediate transfer medium in Example 6 was repeated except that the mixing ratio of the mixture varnish to the masterbatch liquid was changed from 8/2 to 6/4.

Then the procedure for production and evaluation of images in Example 2 was repeated. The results are shown in Table 1.

Example 8

The procedure for preparation of the intermediate transfer medium and the procedure for production and evaluation of images in Example 2 were repeated except that the image forming speed of the color copier was changed from 250 to 500 mm/s.

The results are shown in Table 1.

Example 9

The procedure for preparation of the intermediate transfer medium and the procedure for production and evaluation of images in Example 2 were repeated except that the image forming speed of the color copier was changed from 250 to 60 mm/s.

As a result, large noise was caused due to abnormal discharging, and thereby many discharging marks were observed on the resultant images. The results are shown in Table 1.

Comparative Example 1

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 2/8.

Then the procedure for production and evaluation of images in Example 2 was repeated. The results are shown in Table 1.

Comparative Example 2

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 1/9.

Then the procedure for production and evaluation of images in Example 2 was repeated. The results are shown in Table 1.

Comparative Example 3

The procedure for preparation of the intermediate transfer medium in Example 3 was repeated except that the mixing ratio of the mixture varnish to the masterbatch liquid including a carbon black was changed from 8/2 to 1/9.

Then the procedure for production and evaluation of images in Example 2 was repeated. The results are shown in Table 1.

Comparative Example 4

The procedure for preparation of the intermediate transfer medium in Example 3 was repeated except that the mixing ratio of the mixture varnish to the masterbatch liquid including a carbon black was changed from 8/2 to 3/7.

Then the procedure for production and evaluation of images in Example 2 was repeated.

Comparative Example 5

The procedure for preparation of the intermediate transfer medium in Example 3 was repeated except that the mixing ratio of the mixture varnish to the masterbatch liquid including a carbon black was changed from 8/2 to 9/1.

Then the procedure for production and evaluation of images in Example 2 was repeated.

Example 10

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 3/7.

Then the procedure for production and evaluation of images in Example 2 was repeated. The results are shown in Table 1.

Example 11

The procedure for preparation of the intermediate transfer medium in Example 1 was repeated except that the mixing ratio of the rigid polyimide forming varnish (U-VARNISH S) to the flexible polyimide forming varnish (U-VARNISH A) was changed from 5/5 to 4/6.

Then the procedure for production and evaluation of images in Example 2 was repeated. The results are shown in Table 1.

The results are shown in Table 1.

TABLE 1

| | R/F polyimide ratio | Varnish/ master-batch ratio | Thickness (μm) | Time constant (sec) | Capacitance (pF/cm$^2$) |
|---|---|---|---|---|---|
| Ex. 1 | 5/5 | 8/2 | 78 | 0.74 | 37.49 |
| Ex. 2 | 5/5 | 8/2 | 78 | 0.74 | 37.49 |
| Ex. 3 | 7/3 | 8/2 | 93 | 0.365 | 31.30 |
| Ex. 4 | 6/4 | 8/2 | 85 | 1.476 | 56.34 |
| Ex. 5 | 5/5 | 6/4 | 81 | 1.038 | 38.64 |
| Ex. 6 | 5/5 | 8/2 | 84 | 0.600 | 30.25 |
| Ex. 7 | 5/5 | 6/4 | 90 | 0.561 | 28.42 |
| Ex. 8 | 5/5 | 8/2 | 78 | 0.740 | 37.49 |
| Ex. 9 | 5/5 | 8/2 | 78 | 0.740 | 37.49 |
| Ex. 10 | 3/7 | 8/2 | 95 | 1.379 | 52.63 |
| Ex. 11 | 4/6 | 8/2 | 103 | 1.299 | 49.58 |
| Comp. Ex. 1 | 2/8 | 8/2 | 88 | 2.157 | 200.3 |
| Comp. Ex. 2 | 1/9 | 8/2 | 75 | 1.635 | 170.4 |
| Comp. Ex. 3 | 7/3 | 1/9 | 82 | 1.929 | 194.7 |
| Comp. Ex. 4 | 7/3 | 3/7 | 78 | 2.747 | 262.0 |
| Comp. Ex. 5 | 7/3 | 9/1 | 90 | 4.951 | 70.33 |

| | Specific dielecTric constant | FV (nN) | FH (nN) | FV/FH | Toner scattering (rank) |
|---|---|---|---|---|---|
| Ex. 1 | 3.3 | 18.3 | 15.6 | 0.852 | 3 |
| Ex. 2 | 3.3 | 24.6 | 6.5 | 0.264 | 4 |
| Ex. 3 | 3.29 | 24.6 | 6.5 | 0.264 | 4 |
| Ex. 4 | 3.41 | 24.6 | 6.5 | 0.264 | 3–4 |
| Ex. 5 | 3.54 | 24.6 | 6.5 | 0.264 | 4 |
| Ex. 6 | 4.38 | 24.6 | 6.5 | 0.264 | 4 |
| Ex. 7 | 5.41 | 24.6 | 6.5 | 0.264 | 4 |
| Ex. 8 | 3.3 | 24.6 | 6.5 | 0.264 | 3 |
| Ex. 9 | 3.3 | 24.6 | 6.5 | 0.264 | 3 |
| Ex. 10 | 5.65 | 24.6 | 6.5 | 0.264 | 2–3 |
| Ex. 11 | 5.77 | 24.6 | 6.5 | 0.264 | 2–3 |
| Comp. Ex. 1 | 19.91 | 24.6 | 6.5 | 0.264 | 1 |
| Comp. Ex. 2 | 14.44 | 24.6 | 6.5 | 0.264 | 2 |
| Comp. Ex. 3 | 18.04 | 24.6 | 6.5 | 0.264 | 1 |
| Comp. Ex. 4 | 23.09 | 24.6 | 6.5 | 0.264 | 1 |
| Comp. Ex. 5 | 7.15 | 24.6 | 6.5 | 0.264 | 2 |

Example 12

The intermediate transfer medium of Example 1 was subjected to a folding test. In addition, a reinforced intermediate transfer medium in which a reinforcing material, a PTFE adhesive tape (#5490 from 3M) having a width of 1 cm, is adhered on both edges of the intermediate transfer medium of Example 1 was also prepared and subjected to the folding test.

As a result, the intermediate transfer medium of Example 1 had a crack when subjected to the folding test 200 times, but the reinforced transfer medium had no crack even after being subjected to the folding test 2000 times.

Example 13

The intermediate transfer medium of Example 3 was subjected to a folding test. In addition, a reinforced intermediate transfer medium in which a reinforcing material, a polyimide adhesive tape (No. 360A from Nitto Denko Corporation) having a width of 1 cm, is adhered on both edges of the intermediate transfer medium of Example 3 was also prepared and subjected to the folding test.

As a result, the intermediate transfer medium of Example 1 had a crack when subjected to the folding test 200 times, but the reinforced transfer medium had no crack even after being subjected to the folding test 2000 times.

The images formed in Examples 1 to 11 and Comparative Example 1 to 5 were evaluated with respect to omission.

The method for evaluating omission is as follows.

The half tone image having an area proportion of 40% was observed using a COLOR LASER 3D PROFILE MICROSCOPE (VK8500 from Keyence).

At first, the toner image was digitized. The image was binarized using an image processing software (PHOTOSHOP from Adobe). The binarized image was analyzed using an image analyzing software (IMAGE PRO from Media Cybernetics) to determine omission, i.e., the ratio of the area proportion of the resultant halftone image to the area proportion (i.e., 40%) of the original image. The omission property was graded into the following 3 ranks.

Rank 3: The ratio is not less than 100% (good).

Rank 2: The ratio is not less than 97% to less than 100% (acceptable).

Rank 1: The ratio is less than 97% (bad).

The results are shown in Table 2.

TABLE 2

| | Omission (rank) |
|---|---|
| Ex. 1 | 3 |
| Ex. 2 | 3 |
| Ex. 3 | 3 |
| Ex. 4 | 3 |
| Ex. 5 | 3 |
| Ex. 6 | 3 |
| Ex. 7 | 3 |
| Ex. 8 | 2 |
| Ex. 9 | 2 |
| Ex. 10 | 2 |
| Ex. 11 | 2 |
| Comp. Ex. 1 | 3 |
| Comp. Ex. 2 | 3 |
| Comp. Ex. 3 | 3 |
| Comp. Ex. 4 | 3 |
| Comp. Ex. 5 | 3 |

It is clear from Tables 1 and 2 that the intermediate transfer media of Examples 1 to 7 can produce high quality images without toner scattering and omissions even when a small spherical toner is used.

It is clear from comparison of Examples 10 and 11 with Examples 1 to 7 that it is preferable for the intermediate transfer medium to have both a time constant less than 1.5 seconds and a specific dielectric constant not greater than 5.5.

This document claims priority and contains subject matter related to Japanese Patent Applications Nos. 2004-81148 and 2004-267615, filed on Mar. 19, 2004, and Sep. 14, 2004, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An intermediate transfer medium on which a toner image is to be transferred, having a property such that a surface potential thereon decays with time t according to the following equation (1):

$$V=A\exp(-t/\tau) \quad (1)$$

wherein V represents the surface potential of the intermediate transfer medium in absolute value; A is a constant; and $\tau$ is a dielectric relaxation time constant, wherein the dielectric relaxation time constant $\tau$ is less than 1.5 seconds, wherein the intermediate transfer medium comprises a polyimide resin, and wherein the polyimide resin comprises a rigid polyimide unit which has one phenyl group or a chain of phenyl groups with no other group therebetween, and a flexible polyimide unit which has plural phenyl groups with one or more other groups therebetween.

2. The intermediate transfer medium according to claim 1, wherein the intermediate transfer medium has a specific dielectric constant not greater than 5.5.

3. The intermediate transfer medium according to claim 1, wherein the intermediate transfer medium has a capacitance (C) of 30 to 180 pF/cm2, wherein the capacitance (C) is determined by the following equation (2):

$$C=Q/V \quad (2)$$

wherein Q represents a charge quantity that the intermediate transfer medium has when the intermediate transfer medium has a surface potential V.

4. The intermediate transfer medium according to claim 1, wherein a ratio (R/F) of the rigid polyimide unit (R) to the flexible polyimide unit (F) is from 7/3 to 2/8 by weight.

5. The intermediate transfer medium according to claim 1, wherein the polyimide resin is prepared by reacting a film of a mixture of a rigid polyamide acid and a flexible polyamide acid while or after the mixture is coated to form the film.

6. The intermediate transfer medium according to claim 1, wherein the intermediate transfer medium is a seamless belt.

7. The intermediate transfer medium according to claim 1, wherein intermediate transfer mediate comprises a reinforcing material on both edges thereof.

8. An image forming apparatus comprising:

an image bearing member configured to bear an electrostatic latent image thereon;

a developing device configured to develop the latent image with a developer including a toner to form a toner image on the image bearing member;

an intermediate transfer medium configured to receive the toner image formed on the image bearing member; and a transfer device configured to transfer the toner image on the intermediate transfer medium to a receiving material, wherein the intermediate transfer medium is the intermediate transfer medium according to claim 1.

9. The image forming apparatus according to claim 8, wherein the intermediate transfer medium moves at a linear speed of from 80 to 400 mm/s when receiving the toner image.

10. The image forming apparatus according to claim 8, wherein developing device comprises a toner that has an average circularity of from 0.98 to 1.00.

11. The image forming apparatus according to claim 8, wherein the developing device comprises a toner that has a volume average particle diameter of from 1.0 to 5.0 μm.

12. The image forming apparatus according to claim 8, wherein the developing device comprises a toner that is prepared by a method including reacting a compound having an active hydrogen atom with a polymer in an aqueous medium to prepare a particulate material including a reaction product of the compound and the polymer; and separating the particulate material from the aqueous medium.

13. An intermediate transfer medium on which a toner image is to be transferred, having a property such that a surface potential thereon decays with time t according to the following equation (1):

$$V=A\exp(-t/\tau) \quad (1)$$

wherein V represents the surface potential of the intermediate transfer medium in absolute value; A is a constant; and $\tau$ is a dielectric relaxation time constant, wherein the dielectric relaxation time constant $\tau$ is less than 1.5 seconds, wherein the intermediate transfer medium comprises a carbon black as a resistivity controlling agent, and a nonionic surfactant.

14. The intermediate transfer medium according to claim 13, wherein the intermediate transfer medium has a specific dielectric constant not greater than 5.5.

15. The intermediate transfer medium according to claim 13, wherein the intermediate transfer medium has a capacitance (C) of 30 to 180 pF/cm2, wherein the capacitance (C) is determined by the following equation (2):

$$C=Q/V \quad (2)$$

wherein Q represents a charge quantity that the intermediate transfer medium has when the intermediate transfer medium has a surface potential V.

16. The intermediate transfer medium according to claim 13, wherein the intermediate transfer medium is a seamless belt.

17. The intermediate transfer medium according to claim 13, wherein intermediate transfer mediate comprises a reinforcing material on both edges thereof.

18. An image forming apparatus comprising:

an image bearing member configured to bear an electrostatic latent image thereon;

a developing device configured to develop the latent image with a developer including a toner to form a toner image on the image bearing member;

an intermediate transfer medium configured to receive the toner image formed on the image bearing member; and a transfer device configured to transfer the toner image on the intermediate transfer medium to a receiving material, wherein the intermediate transfer medium is the intermediate transfer medium according to claim 13.

19. The image forming apparatus according to claim 18, wherein the intermediate transfer medium moves at a linear speed of from 80 to 400 mm/s when receiving the toner image.

20. The image forming apparatus according to claim 18, wherein the developing device comprises a toner that has an average circularity of from 0.98 to 1.00.

21. The image forming apparatus according to claim 18, wherein the developing device comprises a toner that has a volume average particle diameter of from 1.0 to 5.0 μm.

22. The image forming apparatus according to claim 18, wherein the developing device comprises a toner that is prepared by a method including reacting a compound having an active hydrogen atom with a polymer in an aqueous medium to prepare a particulate material including a reaction product of the compound and the polymer; and separating the particulate material from the aqueous medium.

* * * * *